US005252442A

United States Patent [19]

Dickerson et al.

[11] Patent Number: 5,252,442

[45] Date of Patent: Oct. 12, 1993

[54] RADIOGRAPHIC ELEMENTS WITH IMPROVED DETECTIVE QUANTUM EFFICIENCIES

[75] Inventors: Robert E. Dickerson, Rochester; Allen K. Tsaur, Fairport, both of N.Y.

[73] Assignee: Eastman Kodak Company, Rochester, N.Y.

[21] Appl. No.: 849,917

[22] Filed: Mar. 12, 1992

Related U.S. Application Data

[63] Continuation-in-part of Ser. No. 699,840, May 14, 1991, abandoned.

[51] Int. Cl.[5] ..... G03C 1/035; G03C 1/46

[52] U.S. Cl. ..... 430/502; 430/567; 430/569; 430/637; 430/966

[58] Field of Search ..... 430/567, 569, 637, 966, 430/502

[56] References Cited

U.S. PATENT DOCUMENTS

| | | | |
|---|---|---|---|
| 4,425,425 | 1/1984 | Abbott et al. | 430/502 |
| 4,425,426 | 1/1984 | Abbott et al. | 430/502 |
| 4,434,226 | 2/1984 | Wilgus et al. | 430/567 |
| 4,797,354 | 1/1989 | Saitou et al. | 430/567 |
| 4,803,150 | 2/1989 | Dickerson et al. | 430/502 |
| 4,900,652 | 2/1990 | Dickerson et al. | 430/502 |
| 4,977,074 | 12/1990 | Saitou et al. | 430/567 |
| 4,994,355 | 2/1991 | Dickerson et al. | 430/509 |
| 5,096,806 | 3/1992 | Nakamura et al. | 430/567 |

FOREIGN PATENT DOCUMENTS 808228 1/1959 United Kingdom .

OTHER PUBLICATIONS

*Research Disclosure*, vol. 232, Aug. 1983, Item 23212 (Mignot French Patent 2,534,036 corresponding).

*Primary Examiner*—Janet C. Baxter
*Attorney, Agent, or Firm*—Carl O. Thomas

[57] ABSTRACT

A radiographic element is disclosed comprised of a film support capable of transmitting radiation to which the radiographic element is responsive having opposed major surfaces, and, coated on the opposed major surfaces, spectrally sensitized high tabularity tabular grain emulsion layer units, and, interposed between each of the emulsion layer units and the support, means for absorbing radiation to which said emulsion layer units are responsive. The emulsion layer units exhibit a coefficient of variation of less than 15 percent, based on the total grain population having an equivalent circular diameter of greater than 0.1 μm, and greater than 97 percent of the projected area of grains having an equivalent circular diameter of greater than 0.1 μm is accounted for by tabular grains having a mean thickness of less than 0.3 μm and a halide content of from 0 to 5 mole percent chloride, from 0 to 5 mole percent iodide, and from 90 to 100 mole percent bromide, based on total silver.

27 Claims, 1 Drawing Sheet

FIG. 1
( PRIOR ART )
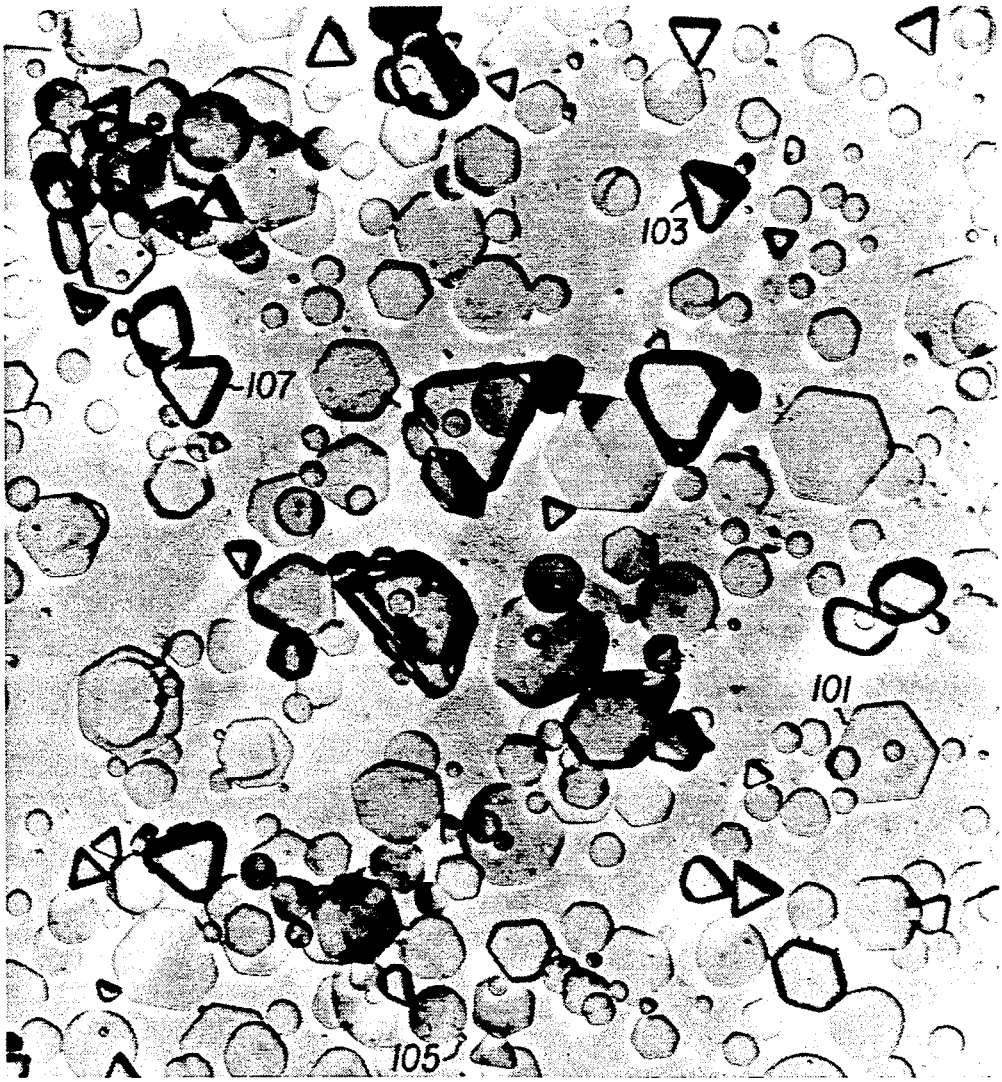
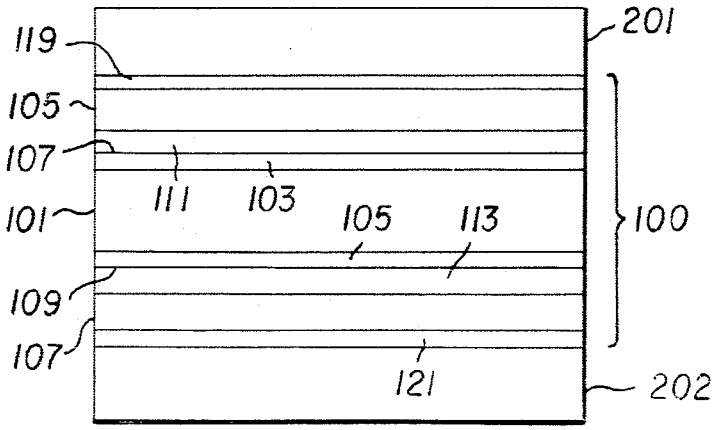
FIG. 2

RADIOGRAPHIC ELEMENTS WITH IMPROVED DETECTIVE QUANTUM EFFICIENCIES

This is a continuation-in-part of U.S. Pat. Ser. No. 699,840, filed May 14, 1991, now abandoned.

FIELD OF THE INVENTION

The invention relates to radiography. More specifically, the invention relates to radiographic elements.

BACKGROUND

Although silver halide emulsions are employed in both photographic imaging and radiographic imaging, these imaging applications are in fact quite dissimilar.

In photography diffuse electromagnetic radiation within or near the visible spectrum is topically reflected from a subject gathered by a lens to expose a silver halide emulsion imaging unit coated on one side of a support.

In radiography X-radiation from an essentially point source is passed through a subject. The object is to record areally variations in the intensity of the X-radiation penetrating the subject. Ideally the image is formed with just that component of the X-radiation that is not scattered during subject penetration. To assist in accomplishing this objective, X-radiation penetrating the subject is commonly passed through a grid which is capable of transmitting a much higher proportion of unscattered X-radiation than scattered X-radiation. The X-radiation pattern is passed to the radiographic element from the grid. No lens is employed in radiographic imaging.

Silver halide radiographic elements actually exhibit relatively low levels of sensitivity to X-radiation, since most of the X-radiation passes through the silver halide grains and only a minor portion is absorbed. Two approaches, neither of which have a counterpart in photography, are commonly used in combination to increase the imaging speed of radiographic elements. First, the absorption efficiency of the radiographic element can be doubled by using a "dual coated" format in which silver halide emulsion layer units are coated on opposite sides of the film support of the radiographic element. The second approach is to mount an intensifying screen adjacent each silver halide emulsion layer unit. The intensifying screen typically consists of a particulate phosphor and binder coated on a support. The phosphor particles absorb X-radiation much more efficiently than silver halide and promptly emit longer wavelength electromagnetic radiation, typically light, which the silver halide emulsion layer unit can absorb more efficiently. A dual coated radiographic element mounted between a front and back pair of intensifying screens typically exhibits an imaging sensitivity about an order of magnitude higher than that of the radiographic element used alone.

Since dual coated radiographic elements divide the image information between the emulsion layer units on opposite sides of the support, the support of the dual coated radiographic element is necessarily transparent to permit transmission viewing of the superimposed images. This leads to the problem of loss of image sharpness due to crossover. Crossover occurs when an intensifying screen exposes not only the adjacent emulsion layer unit, but the emulsion layer unit coated on the opposite side of the support as well.

Abbott et al U.S. Pat. Nos. 4,425,425 and 4,425,426 recognized that the use of spectrally sensitized tabular grain silver halide emulsions offered the capability of dramatically reducing crossover. When spectrally sensitized tabular grain emulsions are compared to emulsions containing spectrally sensitized nontabular grains at the same silver coating coverages, tabular grain emulsions offer dramatic crossover reduction advantages.

Dickerson et al U.S. Pat. Nos. 4,803,150 and 4,900,652 taught the formation of "zero crossover" dual coated radiographic elements by adding to the dual coated radiographic element structures of Abbott et al, cited above, the additional feature of processing solution bleachable crossover reducing dye layers coated between each of the emulsion layer units and the film support. Since the technique used to measure crossover exposure cannot separate the small increment of exposure produced by direct absorption of X-radiation within the emulsion layer units from crossover exposure, "zero crossover" radiographic elements are understood to extend to those that exhibit measured crossover levels of less than 5 percent.

With so many potential sources of image degradation in radiographic imaging that have no counterpart in photography it is not surprising that the analysis of image quality in radiographic elements has evolved differently. The historical and still predominant approach to comparing image quality is to rely on visual inspection and ranking by a trained observer, such as a radiologist. Through side-by-side comparisons of subject exposures, a trained observer can offer an informed opinion of which exposure is offering more imaging information.

A second standard by which the imaging qualities of radiographic elements are compared is detective quantum efficiency (also referred to as DQE). DQE is simply a measure of input noise divided by output noise. Since output noise is a combination of input noise and the increment of noise imparted by the radiographic element, DQE is typically much less than unity (1.0).

From 1937 until the 1950's the Eastman Kodak Company sold a dual coated (Duplitized TM) radiographic film product under the name No-Screen X-Ray Code 5133. Since the product was intended to be exposed directly by X-radiation rather than by an intensifying screen, the grains were not spectrally sensitized. The tabular grains accounted for greater than 50% of the total grain projected area while nontabular grains accounted for greater than 25% of the total grain projected area. Based on remakes of the emulsion it was concluded that the tabular grains had a mean diameter of 2.5 μm, an average tabular grain thickness of 0.36 μm, an average aspect ratio of 7:1, and an average tabularity (defined below) of 19.2. The product which superseded Code 5133 contained essentially nontabular grains.

It was not until after the discovery by Abbott et al, cited above, of reduced crossover in dual coated radiographic products being realized by use of spectrally sensitized tabular grain emulsions that tabular grain emulsions exhibiting high tabularity were introduced into radiographic products Tabular grain emulsions are those in which >50% of the total grain projected area is accounted for tabular grains. Tabular grain emulsions of high tabularity are those that satisfy the relationship:

$$D/t^2 > 25$$

where

D is the equivalent circular diameter (ECD) in micrometers of the tabular grains and t is the thickness in micrometers of the tabular grains.

High tabularity tabular grain emulsions have also been investigated extensively for use in photographic elements for reasons that are totally unrelated to crossover reduction. A variety of photographic advantages that have no applicability to radiography have been identified, such as increased blue to minus blue speed separations and increased sharpness with the incorporation of tabular grains in selected layers of a multilayer format of interest in color photography. A few advantages, such as increased covering power, are applicable to both radiography and some forms of photography.

In view of their divergent exposure requirements it is not surprising that particular modifications of high tabularity tabular grain emulsions intended to optimize performance for a particular photographic application can be detrimental to radiographic utility and vice versa. In addition to the differences in exposure requirements, radiographic elements and photographic elements often require incompatible processing. Radiographic elements are, for example, generally required to be fully processable in less than 90 seconds. This places an upper limit on iodide concentrations in radiographic elements that are well below optimum iodide levels for most color photography requirements.

A number of photographic applications are recognized to be benefitted by having the highest attainable levels of grain uniformity. A photographic concern from the outset of investigations related to high tabularity tabular grain emulsions has been the polydispersity of the grains. In the earliest tabular grain photographic emulsions dispersity concerns were largely focused on the presence of significant populations of nonconforming grain shapes among the tabular grains conforming to an aim grain structure. FIG. 1 is a photomicrograph of an early high tabularity silver bromoiodide emulsion first presented by Wilgus et al U.S. Pat. No. 4,434,226 to demonstrate the variety of grains that can be present. While it is apparent that the majority of the total grain projected area is accounted for by tabular grains, such as grain 101, nonconforming grains are also present. The grain 103 illustrates a nontabular grain. The grain 105 illustrates a fine grain. The grain 107 illustrates a nominally tabular grain of nonconforming thickness. Rods, not shown in FIG. 1, also constitute a common nonconforming grain population in tabular grain silver bromide and bromoiodide emulsions.

While the presence of nonconforming grain shapes in tabular grain emulsions has continued to detract from achieving narrow grain dispersities, as procedures for preparing tabular grains have been improved to reduce the inadvertent inclusion of nonconforming grain shapes, interest has increased in reducing the dispersity of the tabular grains. Only a casual inspection of FIG. 1 is required to realize that the tabular grains sought themselves exhibit a wide range of equivalent circular diameters.

A technique for quantifying grain dispersity that has been applied to both nontabular and tabular grain emulsions is to obtain a statistically significant sampling of the individual grain projected areas, calculate the corresponding ECD of each grain, determine the standard deviation of the grain ECDs, divide the standard deviation of the grain population by the mean ECD of the grains sampled and multiply by 100 to obtain the coefficient of variation (COV) of the grain population as a percentage. While very highly monodisperse (COV $<$ 10 percent) emulsions containing regular nontabular grains can be obtained, even the most carefully controlled precipitations of tabular grain emulsions have rarely achieved a COV of less than 20 percent. *Research Disclosure*, Vol. 232, August 1983, Item 23212 (Mignot French Patent 2,534,036, corresponding) discloses the preparation of silver bromide tabular grain emulsions with COVs ranging down to 15. *Research Disclosure* is published by Kenneth Mason Publications, Ltd., Dudley Annex, 21a North Street, Emsworth, Hampshire P010 7DQ, England.

Saitou et al U.S. Pat. No. 4,797,354 reports in Example 9 a COV of 11.1 percent; however, this number is not comparable to that reported by Mignot. Saitou et al is reporting only the COV within a selected tabular grain population. Excluded from these COV calculations is the nonconforming grain population within the emulsion, which, of course, is the grain population that has the maximum impact on increasing grain dispersity and overall COV. When the total grain populations of the Saitou et al emulsions are sampled, significantly increased COVs result. In a remake of the Example 9 emulsion of Saitou et al a COV of 21.3 percent was observed when COV was based on the total grain population.

CROSS-REFERENCE FILINGS

The following concurrently filed, commonly assigned patent applications are cross-referenced:

Tsaur and Kam-Ng U.S. Pat. Ser. No. 700,220, filed May 14, 1991, titled PROCESS OF PREPARING A REDUCED DISPERSITY TABULAR GRAIN EMULSION, now U.S. Pat. No. 5,147,771 discloses a process for the preparation of tabular grain emulsions of reduced dispersity that employs an alkylene oxide block copolymer surfactant that contains two terminal lipophilic block units joined by a central hydrophilic block unit.

Tsaur and Kam-Ng U.S. Pat. Ser. No., 700,019, filed May 14, 1991, titled PROCESS PREPARING A REDUCED DISPERSITY TABULAR G EMULSION, now U.S. Pat. No. 5,171,659 discloses a process for the preparation of tabular grain emulsions of reduced dispersity that employs an alkylene oxide block copolymer surfactant that contains two terminal hydrophilic block units joined by a central lipophilic block unit.

Tsaur and Kam-Ng U.S. Pat. Ser. No. 699,851, filed May 14, 1991, titled PROCESS PREPARING A REDUCED DISPERSITY TABULAR GRAIN EMULSION, now U.S. Pat. No. 5,147,773 discloses a process for the preparation of tabular grain emulsions of reduced dispersity that employs an alkylene oxide block copolymer surfactant that contains at least three terminal hydrophilic block units joined by a central lipophilic block linking unit.

Tsaur and Kam-Ng U.S. Pat. Ser. No. 700,020, filed May 14, 1991, titled PROCESS OF PREPARING A REDUCED DISPERSITY TABULAR GRAIN EMULSION, now U.S. Pat. No. 5,147,772 discloses a process for the preparation of tabular grain emulsions of reduced dispersity that employs an alkylene oxide block copolymer surfactant that contains at least three terminal lipophilic block units joined by a central hydrophilic block linking unit.

Tsaur and Kam-Ng U.S. Pat. Ser. No. 699,855, filed May 14, 1991, titled A VERY LOW COEFFICIENT OF VARIATION TABULAR GRAIN EMULSION, now U.S. Pat. 5,147,773, discloses a coprecipitated grain population having a coefficient of variation of less than 10 percent and consisting essentially of tabular grains.

SUMMARY OF THE INVENTION

In one aspect, this invention is directed to a radiographic element comprised of a film support capable of transmitting radiation to which the radiographic element is responsive having opposed major surfaces, and, coated on the opposed major surfaces, emulsion layer units comprised of spectrally sensitized silver halide tabular grains having an average tabularity of greater than 25, where the tabularity of each tabular grain is the ratio of its equivalent circular diameter in micrometers divided by the square of its thickness in micrometers, and, interposed between each of the emulsion layer units and the support, means for absorbing radiation to which the emulsion layer units are responsive.

The radiographic elements of the invention are characterized in that each of the emulsion layer units exhibit a coefficient of variation of less than 15 percent, based on their total grain population having an equivalent circular diameter of greater than 0.1 μm, and greater than 97 percent of the projected area of the grain population having an equivalent circular diameter of greater than 0.1 μm is accounted for by tabular grains having a mean thickness of less than 0.3 μm and a halide content of from 0 to 5 mole percent chloride, from 0 to 5 mole percent iodide, and from 90 to 100 mole percent bromide, based on total silver.

It has been discovered that the radiographic elements of the invention are capable of providing radiographic images of improved quality. The radiographic elements can, for example, offer enhancements in detective quantum efficiencies.

BRIEF DESCRIPTION OF THE DRAWINGS

FIG. 1 is a shadowed photomicrograph of an early high tabularity tabular grain emulsion (Wilgus et al U.S. Pat. No. 4,434,226).

FIG. 2 is a schematic cross sectional view of a radiographic element in combination with a pair of intensifying screens.

DESCRIPTION OF PREFERRED EMBODIMENTS

Referring to FIG. 2, in the assembly shown a radiographic element 100 according to this invention is positioned between a pair of light emitting intensifying screens 201 and 202. The radiographic element is comprised of a transparent, typically blue tinted, radiographic support element 101. As shown, the support additionally includes optional subbing layer units 103 and 105, each of which can be formed of one more adhesion promoting layers. On the first and second opposed major faces 107 and 109 of the support formed by the subbing layer units are crossover reducing layer units 111 and 113. Overlying the crossover reducing layer units 111 and 113 are silver halide emulsion layer units 115 and 117, respectively. Overlying the emulsion layer units 115 and 117 are optional protective overcoat layers 119 and 121, respectively.

In use, the assembly is imagewise exposed to X-radiation. The X-radiation is principally absorbed by the intensifying screens 201 and 202, which promptly emit light as a direct function of X-radiation exposure.

Considering first the light emitted by screen 201, the light recording latent image forming emulsion layer unit is positioned adjacent this screen to receive the light which it emits. Because of the proximity of the screen 201 to the emulsion layer unit 115 only minimal light scattering occurs before latent image forming absorption occurs in this layer. Hence light emission from screen 201 forms a sharp image in emulsion layer unit 115.

However, not all of the light emitted by screen is absorbed within emulsion layer unit 115. This remaining light, unless otherwise absorbed, will reach the remote emulsion layer unit 117, resulting in a highly unsharp image being formed in this remote emulsion layer unit. Both crossover reducing layer units 111 and 113 are interposed between the screen 201 and the remote emulsion layer unit and are capable of intercepting and attenuating this remaining light. Both of these layers thereby contribute to reducing crossover exposure of emulsion layer unit 117 by the screen 201. In their preferred construction the radiographic elements of the invention exhibit a crossover of less than 10 percent and optimally less than 5 percent.

In an exactly analogous manner the screen 202 produces a sharp image in emulsion layer unit 117, and the light absorbing layer units 111 and 113 similarly reduce crossover exposure of the emulsion layer unit 115 by the screen 202. While only one of the crossover reducing layer units 111 and 113 are required to prevent crossover exposures from occurring, it is preferred that both be present, since the crossover emulsion layer units when coated between each emulsion layer unit and the support also act as antihalation layers. That is, by their presence they also reduce loss of image sharpness due to reflection of light that would otherwise occur at the interface of each emulsion layer unit and the underlying support.

Following exposure to produce a stored latent image, the radiographic element is removed from association with the intensifying screens 201 and 202 and processed in a conventional manner. Typically, the radiographic element is brought into contact with an aqueous alkaline developer, such as hydroquinone-Phenidone TM (1-phenyl-3-pyrazolidone) developer having a pH of 10.0, a specific formulation of which is set out in Dickerson et al U.S. Pat. No. 4,900,652. The alkaline developer permeates the overcoat layers, the emulsion layer units, and the crossover reducing layer units, converting the silver halide latent image to a viewable silver image and simultaneously decolorizing the crossover reducing layers. Conventional post development steps, such as stop bath contact, fixing, and washing can occur. In its preferred construction the radiographic element can be fully processed (including silver image processing in the emulsion layer units and decolorization of the crossover reducing layer units) in less than 90 seconds following contact with the aqueous alkaline processing solution of pH 10.0. In their preferred construction the radiographic elements can be processed in a conventional radiographic rapid access processor, such as in an RP-X-Omat TM processor.

This invention improves the properties of radiographic elements of the general construction described above containing high tabularity tabular grain emulsions by employing tabular grain emulsions prepared by novel processes that (1) increase the proportion of the total grain population accounted for by tabular grains and (2) increase the monodispersity of the total grain population forming the emulsion layer units. The radiographic elements of this invention exhibit a coefficient of variation of the tabular grain emulsions that is less than 15 percent (preferably less than 10 percent), based on the total grain population of the emulsion having an equivalent circular diameter of greater than 0.1 μm. The low coefficient of variation of the total grain population is made possible by producing an emulsion in which the tabular grain population accounts for all or very nearly all (greater than 97 percent and optimally greater than 98 percent) of the total grain projected area of grains having an equivalent circular diameter of greater than 0.1 μm and by reducing the dispersity observed within the tabular grain population itself. The radiographic elements employ in their emulsion layer units high tabularity tabular grain silver halide emulsions that consist essentially of tabular grains and minimum or near minimum coefficients of variations, based on the total grain population.

As precipitated by the procedures disclosed below, there are only negligible quantities present of grains having equivalent circular diameters of 0.1 μm or less. However, it is recognized that it is conventional practice in preparing emulsions for radiographic elements to blend in small quantities of small diameter grains (sometimes referred to as "dust") to adjust the profile of the characteristic curve. These small grains can range up to 0.1 μm in size, but are typically Lippmann emulsions having mean gran equivalent circular diameters of about 0.05 μm. Grains of up to 0.1 μm in equivalent circular diameter are too small to participate to any significant degree in light capture or light scattering within the visible spectrum. The role of these blended small grain components, when present, is more analogous to image modifiers than to that of the imaging grain population.

The radiographic elements of this invention have been realized by the discovery and optimization of novel processes for the precipitation of tabular grain emulsions of reduced grain dispersities. These processes are capable of preparing emulsions suited for radiographic use. The emulsions applied to radiographic use preferably have a grain halide content of from 0 to 5 mole percent chloride, from 0 to 5 mole percent iodide and from 90 to 100 mole percent bromide, based on total silver. The grain population can consist essentially of silver bromide as the sole silver halide. Silver bromide is incorporated in the grains during both grain nucleation and growth. Silver iodide and/or silver chloride can also be present in the grains, if desired. The presence of iodide is particularly beneficial to increasing emulsion speed when present in even very small amounts, such as $\geqq 0.1$ mole percent, based on silver. However, the speed advantage must be balanced against producing warmer image tones and lengthened processing times. It is therefore preferred to limit iodide to less than 5 mole percent (optimally less than 3 mole percent) based on silver. It is preferred to limit chloride concentrations to 5 mole percent or less, based on total halide, to obtain thin tabular grains—that is, emulsions with mean tabular grain thicknesses of less than 0.2 μm. In producing tabular grains having thicknesses up to less than 0.3 μm still higher levels of chloride can be incorporated in the tabular grains, if desired. Further, once the tabular grains have been formed, additional silver chloride can be deposited at their corners or edges to increase sensitivity, as taught by Maskasky U.S. Pat. No. 4,435,501.

Grain populations consisting essentially of tabular grains having mean thicknesses in the range of from 0.080 to 0.3 μm (preferably 0.2 μm) and mean tabularities (as defined above) of greater than 25 are well within the capabilities of the precipitation procedures set forth below. These ranges permit any mean tabular grain ECD to be selected appropriate for the radiographic application. In other words, the present invention is compatible with the full range of mean ECDs of conventional tabular grain emulsions. A mean ECD of about 20 μm is typically regarded as the upper limit for radiographic utility. For most radiographic applications the tabular grains exhibit a mean ECD of 10 μm or less. Since increased ECDs contribute to achieving higher tabularities and higher imaging speeds, it is generally preferred that mean ECDs of the tabular grains be at least about 0.6 μm.

Any mean tabular grain aspect ratio within the mean tabular grain thickness and tabularity ranges indicated is contemplated. Mean tabular grain aspect ratios for the tabular grains preferably range from 5 to 100 or more. This range of mean aspect ratios includes intermediate aspect ratio (5 to 8) tabular grain emulsions and high (>8) tabular grain emulsions. For the majority of radiographic applications mean tabular grain aspect ratios in the range of from about 10 to 60 are preferred.

While mean aspect ratios have been most extensively used in the art to characterize dimensionally tabular grain emulsions, mean tabularities ($D/t^2$, as defined) provide an even better quantitative measure of the qualities that set tabular grain populations apart from nontabular grain populations. The emulsions of the invention contain exhibit tabularities of greater than 25. Typically mean tabularities of the tabular grain emulsions range up to about 400.

The emulsions contemplated for use have been made available by the discovery and optimization of improved processes for the preparation of tabular grain emulsions by (a) first forming a population of grain nuclei, (b) ripening out a portion of the grain nuclei in the presence of a ripening agent, and (c) undertaking post-ripening grain growth. Minimum COV coprecipitated grain population emulsions consisting essentially of tabular grains satisfying the requirements of this invention has resulted from the discovery of specific techniques for forming the population of grain nuclei.

To achieve the lowest possible grain dispersities the first step is undertake formation of the silver halide grain nuclei under conditions that promote uniformity. Prior to forming the grain nuclei bromide ion is added to the dispersing medium. Although other halides can be added to the dispersing medium along with silver, prior to introducing silver, halide ions in the dispersing medium consist essentially of bromide ions.

The balanced double jet precipitation of grain nuclei is specifically contemplated in which a aqueous silver salt solution and an aqueous bromide salt are concurrently introduced into a dispersing medium containing water and a hydrophilic colloid peptizer. One or both of chloride and iodide salts can be introduced through the bromide jet or as a separate aqueous solution through a separate jet. It is preferred to limit the concentration of chloride and/or iodide to the overall levels described above or less during grain nucleation. Silver nitrate is the most commonly utilized silver salt while the halide salts most commonly employed are ammonium halides and alkali metal (e.g., lithium, sodium or potassium) halides. The ammonium counter ion does not function as a ripening agent since the dispersing medium is at an acid pH—i.e., less than 7.0.

Instead of introducing aqueous silver and halide salts through separate jets a uniform nucleation can be achieved by introducing a Lippmann emulsion into the dispersing medium. Since the Lippmann emulsion grains typically have a mean ECD of less than 0.05 μm, a small fraction of the Lippmann grains initially introduced serve as deposition sites while all of the remaining Lippmann grains dissociate into silver and halide ions that precipitate onto grain nuclei surfaces. Techniques for using small, preformed silver halide grains as a feedstock for emulsion precipitation are illustrated by Mignot U.S. Pat. No. 4,334,012; Saito U.S. Pat. No. 4,301,241; and Solberg et al U.S. Pat. No. 4,433,048.

The low COV emulsions contemplated for use can be prepared by producing prior to ripening a population of parallel twin plane containing grain nuclei in the presence of selected surfactants. Specifically, it has been discovered that the dispersity of the tabular grain emulsions of this invention can be reduced by introducing parallel twin planes in the grain nuclei in the presence of one or a combination of polyalkylene oxide block copolymer surfactants. Polyalkylene oxide block copolymer surfactants generally and those contemplated for use in preparing the emulsions of this invention in particular are well known and have been widely used for a variety of purposes. They are generally recognized to constitute a major category of nonionic surfactants. For a molecule to function as a surfactant it must contain at least one hydrophilic unit and at least one lipophilic unit linked together. A general review of block copolymer surfactants is provided by I. R. Schmolka, "A Review of Block Polymer Surfactants", J. Am. Oil Chem. Soc., Vol. 54, No. 3, 1977, pp. 110–116, and A. S. Davidsohn and B. Milwidsky, *Synthetic Detergents*, John Wiley & Sons, N.Y. 1987, pp. 29–40, and particularly pp. 34–36, the disclosures of which are here incorporated by reference.

One category of polyalkylene oxide block copolymer surfactant found to be useful in the preparation of the emulsions is comprised of two terminal lipophilic alkylene oxide block units linked by a hydrophilic alkylene oxide block unit accounting for at least 4 percent of the molecular weight of the copolymer. These surfactants are hereinafter referred to category S-I surfactants.

The category S-I surfactants contain at least two terminal lipophilic alkylene oxide block units linked by a hydrophilic alkylene oxide block unit and can be, in a simple form, schematically represented as indicated by diagram I below:

| | | |
|---|---|---|
| LAO1 | HAO1 | LAO1 |

(I)

where

LAO1 in each occurrence represents a terminal lipophilic alkylene oxide block unit and HAO1 represents a hydrophilic alkylene oxide block linking unit.

It is generally preferred that HAO1 be chosen so that the hydrophilic block unit constitutes from 4 to 96 percent of the block copolymer on a total weight basis.

It is, of course, recognized that the block diagram I above is only one example of a polyalkylene oxide block copolymer having at least two terminal lipophilic block units linked by a hydrophilic block unit. In a common variant structure interposing a trivalent amine linking group in the polyalkylene oxide chain at one or both of the interfaces of the LAO1 and HAO1 block units can result in three or four terminal lipophilic groups.

In their simplest possible form the category S-I polyalkylene oxide block copolymer surfactants are formed by first condensing ethylene glycol and ethylene oxide to form an oligomeric or polymeric block repeating unit that serves as the hydrophilic block unit and then completing the reaction using 1,2-propylene oxide. The propylene oxide adds to each end of the ethylene oxide block unit. At least six 1,2-propylene oxide repeating units are required to produce a lipophilic block repeating unit. The resulting polyalkylene oxide block copolymer surfactant can be represented by formula II:

$$HO-(\overset{\overset{CH_3}{|}}{C}HCH_2O)_x-(CH_2CH_2O)_y-(CH_2\overset{\overset{CH_3}{|}}{C}HO)_{x'}-H \quad \text{(II)}$$

where x and x' are each at least 6 and can range up to 120 or more and y is chosen so that the ethylene oxide block unit maintains the necessary balance of lipophilic and hydrophilic qualities necessary to retain surfactant activity. It is generally preferred that y be chosen so that the hydrophilic block unit constitutes from 4 to 96 percent by weight of the total block copolymer. Within the above ranges for x and x', y can range from 2 to 300 or more.

Generally any category S-I surfactant block copolymer that retains the dispersion characteristics of a surfactant can be employed. It has been observed that the surfactants are fully effective either dissolved or physically dispersed in the reaction vessel. The dispersal of the polyalkylene oxide block copolymers is promoted by the vigorous stirring typically employed during the preparation of tabular grain emulsions. In general surfactants having molecular weights of less than about 16,000, preferably less than about 10,000, are contemplated for use.

In a second category, hereinafter referred to as category S-II surfactants, the polyalkylene oxide block copolymer surfactants contain two terminal hydrophilic alkylene oxide block units linked by a lipophilic alkylene oxide block unit and can be, in a simple form, schematically represented as indicated by diagram III below:

| | | |
|---|---|---|
| HAO2 | LAO2 | HAO2 |

(III)

where

HAO2 in each occurrence represents a terminal hydrophilic alkylene oxide block unit and LAO2 represents a lipophilic alkylene oxide block linking unit.

It is generally preferred that LAO2 be chosen so that the lipophilic block unit constitutes from 4 to 96 percent of the block copolymer on a total weight basis.

It is, of course, recognized that the block diagram III above is only one example of a category S-II polyalkylene oxide block copolymer having at least two terminal hydrophilic block units linked by a lipophilic block unit. In a common variant structure interposing a trivalent amine linking group in the polyakylene oxide chain at one or both of the interfaces of the LAO2 and HAO2 block units can result in three or four terminal hydrophilic groups.

In their simplest possible form the category S-II polyalkylene oxide block copolymer surfactants are formed by first condensing 1,2-propylene glycol and 1,2-propylene oxide to form an oligomeric or polymeric block repeating unit that serves as the lipophilic block unit and then completing the reaction using ethylene oxide. Ethylene oxide is added to each end of the 1,2-propylene oxide block unit. At least thirteen (13) 1,2-propylene oxide repeating units are required to produce a lipophilic block repeating unit. The resulting polyalkylene oxide block copolymer surfactant can be represented by formula IV:

$$HO-(CH_2CH_2O)_{y'}-(\overset{CH_3}{\overset{|}{C}}HCH_2O)_x-(CH_2CH_2O)_{y'}-H \qquad (IV)$$

where x is at least 13 and can range up to 490 or more and y and y' are chosen so that the ethylene oxide block units maintain the necessary balance of lipophilic and hydrophilic qualities necessary to retain surfactant activity. It is generally preferred that x be chosen so that the lipophilic block unit constitutes from 4 to 96 percent by weight of the total block copolymer; thus, within the above range for x, y and y' can range from 1 to 320 or more.

Any category S-II block copolymer surfactant that retains the dispersion characteristics of a surfactant can be employed. It has been observed that the surfactants are fully effective either dissolved or physically dispersed in the reaction vessel. The dispersal of the polyalkylene oxide block copolymers is promoted by the vigorous stirring typically employed during the preparation of tabular grain emulsions. In general surfactants having molecular weights of less than about 30,000, preferably less than about 20,000, are contemplated for use.

In a third category, hereinafter referred to as category S-III surfactants, the polyalkylene oxide surfactants contain at least three terminal hydrophilic alkylene oxide block units linked through a lipophilic alkylene oxide block linking unit and can be, in a simple form, schematically represented as indicated by formula V below:

$$(H-HAO3)_z-LOL-(HAO3-H)_{z'} \qquad (V)$$

where

HAO3 in each occurrence represents a terminal hydrophilic alkylene oxide block unit, LOL represents a lipophilic alkylene oxide block linking unit, z is 2 and z' is 1 or 2.

The polyalkylene oxide block copolymer surfactants employed can take the form shown in formula VI:

$$(H-HAO3-LAO3)_z-L-(LAO3-HAO3-H)_{z'} \qquad (VI)$$

where

HAO3 in each occurrence represents a terminal hydrophilic alkylene oxide block unit, LAO3 in each occurrence represents a lipophilic alkylene oxide block unit, L represents a linking group, such as amine or diamine, z is 2 and z' is 1 or 2.

The linking group L can take any convenient form. It is generally preferred to choose a linking group that is itself lipophilic. When z+z' equal three, the linking group must be trivalent. Amines can be used as trivalent linking groups. When an amine is used to form the linking unit L, the polyalkylene oxide block copolymer surfactants employed can take the form shown in formula VII:

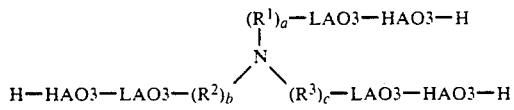

where

HAO3 and LAO3 are as previously defined;

$R^1$, $R^2$ and $R^3$ are independently selected hydrocarbon linking groups, preferably phenylene groups or alkylene groups containing from 1 to 10 carbon atoms; and a, b and c are independently zero or 1.

To avoid steric hindrances it is generally preferred that at least one (optimally at least two) of a, b and c be 1. An amine (preferably a secondary or tertiary amine) having hydroxy functional groups for entering into an oxyalkylation reaction is a contemplated starting material for forming a polyalkylene oxide block copolymer satisfying formula VII.

When z+z' equal four, the linking group must be tetravalent. Diamines are preferred tetravalent linking groups. When a diamine is used to form the linking unit L, the polyalkylene oxide block copolymer surfactants employed can take the form shown in formula VIII:

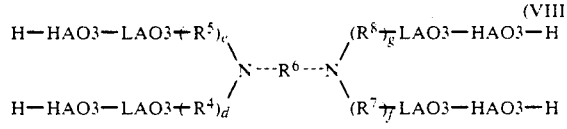

where

HAO3 and LAO3 are as previously defined;

$R^4$, $R^5$, $R^6$, $R^7$ and $R^8$ are independently selected hydrocarbon linking groups, preferably phenylene groups or alkylene groups containing from 1 to 10 carbon atoms; and d, e, f and g are independently zero or 1.

It is generally preferred that LAO3 be chosen so that LOL lipophilic block unit accounts for from 4 to less than 96 percent, preferably from 15 to 95 percent, optimally 20 to 90 percent, of the molecular weight of the copolymer.

In a fourth category, hereinafter referred to as category S-IV surfactants, the polyalkylene oxide block copolymer surfactants employed contain at least three terminal lipophilic alkylene oxide block units linked through a hydrophilic alkylene oxide block linking unit and can be, in a simple form, schematically represented as indicated by formula IX below:

$$(H-LAO4)_z-HOL-(LAO4-H)_{z'} \qquad (IX)$$

where

LAO4 in each occurrence represents a terminal lipophilic alkylene oxide block unit, HOL represents a hydrophilic alkylene oxide block linking unit, z is 2 and z' is 1 or 2.

The polyalkylene oxide block copolymer surfactants employed can take the form shown in formula X:

$$(H—LAO4—HAO4)_z—L'—(HAO4—LAO4—H)_{z'} \quad (X)$$

where

HAO4 in each occurrence represents a hydrophilic alkylene oxide block unit,

LAO4 in each occurrence represents a terminal lipophilic alkylene oxide block unit, L' represents a linking group, such as amine or diamine, z is 2 and z' is 1 or 2.

The linking group L' can take any convenient form. It is generally preferred to choose a linking group that is itself hydrophilic. When z+z' equal three, the linking group must be trivalent. Amines can be used as trivalent linking groups. When an amine is used to form the linking unit L', the polyalkylene oxide block copolymer surfactants employed can take the form shown in formula XI:

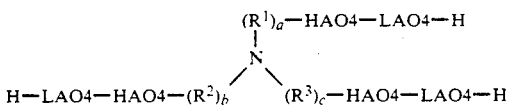

(XI)

where

HAO4 and LAO4 are as previously defined;

$R^1$, $R^2$ and $R^3$ are independently selected hydrocarbon linking groups, preferably phenylene groups or alkylene groups containing from 1 to 10 carbon atoms; and a, b and c are independently zero or 1.

To avoid steric hindrances it is generally preferred that at least one (optimally at least two) of a, b and c be 1. An amine (preferably a secondary or tertiary amine) having hydroxy functional groups for entering into an oxyalkylation reaction is a contemplated starting material for forming a polyalkylene oxide block copolymer satisfying formula XI.

When z+z' equal four, the linking group must be tetravalent. Diamines are preferred tetravalent linking groups. When a diamine is used to form the linking unit L', the polyalkylene oxide block copolymer surfactants employed can take the form shown in formula XII:

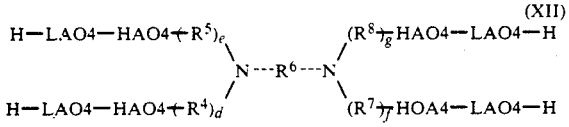

(XII)

where

HAO4 and LAO4 are as previously defined;

$R^4$, $R^5$, $R^6$, $R^7$ and $R^8$ are independently selected hydrocarbon linking groups, preferably phenylene groups or alkylene groups containing from 1 to 10 carbon atoms; and d, e, f and g are independently zero or 1.

It is generally preferred that LAO4 be chosen so that the HOL hydrophilic block unit accounts for from 4 to 96 percent, preferably from 5 to 85 percent, of the molecular weight of the copolymer.

In their simplest possible form the polyalkylene oxide block copolymer surfactants of categories S-III and S-IV employ ethylene oxide repeating units to form the hydrophilic (HAO3 and HAO4) block units and 1,2-propylene oxide repeating units to form the lipophilic (LAO3 and LAO4) block units. At least three propylene oxide repeating units are required to produce a lipophilic block repeating unit. When so formed, each H—HAO3—LAO3— or H—LAO4—HAO4— group satisfies formula XIIIa or XIIIb, respectively:

$$H—(OCH_2CH_2)_y—(O\overset{CH_3}{\overset{|}{C}}HCH_2)_x— \quad (XIIIa)$$

$$H—(O\overset{CH_3}{\overset{|}{C}}HCH_2)_x—(OCH_2CH_2)_y— \quad (XIIIb)$$

where x is at least 3 and can range up to 250 or more and y is chosen so that the ethylene oxide block unit maintains the necessary balance of lipophilic and hydrophilic qualities necessary to retain surfactant activity. This allows y to be chosen so that the hydrophilic block units together constitute from greater than 4 to 96 percent (optimally 10 to 80 percent) by weight of the total block copolymer. In this instance the lipophilic alkylene oxide block linking unit, which includes the 1,2-propylene oxide repeating units and the linking moieties, constitutes from 4 to 96 percent (optimally 20 to 90 percent) of the total weight of the block copolymer. Within the above ranges, y can range from 1 (preferably 2) to 340 or more.

The overall molecular weight of the polyalkylene oxide block copolymer surfactants of categories S-III and S-IV have a molecular weight of greater than 1100, preferably at least 2,000. Generally any such block copolymer that retains the dispersion characteristics of a surfactant can be employed. It has been observed that the surfactants are fully effective either dissolved or physically dispersed in the reaction vessel. The dispersal of the polyalkylene oxide block copolymers is promoted by the vigorous stirring typically employed during the preparation of tabular grain emulsions. In general category S-III surfactants having molecular weights of less than about 60,000, preferably less than about 40,000, are contemplated for use, category S-IV surfactants having molecular weight of less than 50,000, preferably less than about 30,000, are contemplated for use.

While commercial surfactant manufacturers have in the overwhelming majority of products selected 1,2-propylene oxide and ethylene oxide repeating units for forming lipophilic and hydrophilic block units of nonionic block copolymer surfactants on a cost basis, it is recognized that other alkylene oxide repeating units can, if desired, be substituted in any of the category S-I, S-II, S-III and S-IV surfactants, provided the intended lipophilic and hydrophilic properties are retained. For example, the propylene oxide repeating unit is only one of a family of repeating units that can be illustrated by formula XIV $$-(OCH\overset{R^9}{\overset{|}{C}}H_2)- \quad \text{(XIV)}$$

where $R^9$ is a lipophilic group, such as a hydrocarbon—e.g., alkyl of from 1 to 10 carbon atoms or aryl of from 6 to 10 carbon atoms, such as phenyl or naphthyl.

In the same manner, the ethylene oxide repeating unit is only one of a family of repeating units that can be illustrated by formula XV:

$$-(OCH\overset{R^{10}}{\overset{|}{C}}H_2)- \quad \text{(XV)}$$

where $R^{10}$ is hydrogen or a hydrophilic group, such as a hydrocarbon group of the type forming $R^9$ above additionally having one or more polar substituents—e.g., one, two, three or more hydroxy and/or carboxy groups.

In each of the surfactant categories each of block units contain a single alkylene oxide repeating unit selected to impart the desired hydrophilic or lipophilic quality to the block unit in which it is contained. Hydrophilic-lipophilic balances (HLB's) of commercially available surfactants are generally available and can be consulted in selecting suitable surfactants.

Only very low levels of surfactant are required in the emulsion at the time parallel twin planes are being introduced in the grain nuclei to reduce the grain dispersity of the emulsion being formed. Surfactant weight concentrations are contemplated as low as 0.1 percent, based on the interim weight of silver—that is, the weight of silver present in the emulsion while twin planes are being introduced in the grain nuclei. A preferred minimum surfactant concentration is 1 percent, based on the interim weight of silver. A broad range of surfactant concentrations have been observed to be effective. No further advantage has been realized for increasing surfactant weight concentrations above 100 percent of the interim weight of silver using category S-I surfactants or above 50 percent of the interim weight of silver using category S-II, S-III or S-IV surfactants. However, surfactant concentrations of 200 percent of the interim weight of silver or more are considered feasible using category S-I surfactants or 100 percent or more using category S-II, S-III or S-IV surfactants.

The preparation process is compatible with either of the two most common techniques for introducing parallel twin planes into grain nuclei. The preferred and most common of these techniques is to form the grain nuclei population that will be ultimately grown into tabular grains while concurrently introducing parallel twin planes in the same precipitation step. In other words, grain nucleation occurs under conditions that are conducive to twinning. The second approach is to form a stable grain nuclei population and then adjust the pAg of the interim emulsion to a level conducive to twinning.

Regardless of which approach is employed, it is advantageous to introduce the twin planes in the grain nuclei at an early stage of precipitation. It is contemplated to obtain a grain nuclei population containing parallel twin planes using less than 2 percent of the total silver used to form the tabular grain emulsion. It is usually convenient to use at least 0.05 percent of the total silver to form the parallel twin plane containing grain nuclei population, although this can be accomplished using even less of the total silver. The longer introduction of parallel twin planes is delayed after forming a stable grain nuclei population the greater is the tendency toward increased grain dispersity.

At the stage of introducing parallel twin planes in the grain nuclei, either during initial formation of the grain nuclei or immediately thereafter, the lowest attainable levels of grain dispersity in the completed emulsion are achieved by control of the dispersing medium.

The pAg of the dispersing medium is preferably maintained in the range of from 5.4 to 10.3 and, for achieving a COV of less than 10 percent, optimally in the range of from 7.0 to 10.0. At a pAg of greater than 10.3 a tendency toward increased tabular grain ECD and thickness dispersities is observed. Any convenient conventional technique for monitoring and regulating pAg can be employed.

Reductions in grain dispersities have also been observed as a function of the pH of the dispersing medium. Both the incidence of nontabular grains and the thickness dispersities of the nontabular grain population have been observed to decrease when the pH of the dispersing medium is less than 6.0 at the time parallel twin planes are being introduced into the grain nuclei. The pH of the dispersing medium can be regulated in any convenient conventional manner. A strong mineral acid, such as nitric acid, can be used for this purpose.

Grain nucleation and growth occurs in a dispersing medium comprised of water, dissolved salts and a conventional peptizer. Hydrophilic colloid peptizers such as gelatin and gelatin derivatives are specifically contemplated. Peptizer concentrations of from 20 to 800 (optimally 40 to 600) grams per mole of silver introduced during the nucleation step have been observed to produce emulsions of the lowest grain dispersity levels.

The formation of grain nuclei containing parallel twin planes is undertaken at conventional precipitation temperatures for radiographic emulsions, with temperatures in the range of from 20° to 80° C. being particularly preferred and temperature of from 20° to 60° C. being optimum.

Once a population of grain nuclei containing parallel twin planes has been established as described above, the next step is to reduce the dispersity of the grain nuclei population by ripening. The objective of ripening grain nuclei containing parallel twin planes to reduce dispersity is disclosed by both Himmelwright U.S. Pat. No. 4,477,565 and Nottorf U.S. Pat. 4,722,886, the disclosures of which are here incorporated by reference. Ammonia and thioethers in concentrations of from about 0.01 to 0.1 N constitute preferred ripening agent selections.

Instead of introducing a silver halide solvent to induce ripening it is possible to accomplish the ripening step by adjusting pH to a high level—e.g., greater than 9.0. A ripening process of this type is disclosed by Buntaine and Brady U.S. Pat. No. 5,013,641, issued May 7, 1991. In this process the post nucleation ripening step is performed by adjusting the pH of the dispersing medium to greater than 9.0 by the use of a base, such as an alkali hydroxide (e.g., lithium, sodium or potassium hydroxide) followed by digestion for a short period (typically 3 to 7 minutes). At the end of the ripening step the emulsion is again returned to the acidic pH ranges conventionally chosen for silver halide precipitation (e.g. less than 6.0) by introducing a conventional acidifying agent, such as a mineral acid (e.g., nitric acid).

Some reduction in dispersity will occur no matter how abbreviated the period of ripening. It is preferred to continue ripening until at least about 20 percent of the total silver has been solubilized and redeposited on the remaining grain nuclei. The longer ripening is extended the fewer will be the number of surviving nuclei. This means that progressively less additional silver halide precipitation is required to produce tabular grains of an aim ECD in a subsequent growth step. Looked at another way, extending ripening decreases the size of the emulsion make in terms of total grams of silver precipitated. Optimum ripening will vary as a function of aim emulsion requirements and can be adjusted as desired.

Once nucleation and ripening have been completed, further growth of the emulsions can be undertaken in any conventional manner consistent with achieving desired final mean grain thicknesses and ECDs. The halides introduced during grain growth can be selected independently of the halide selections for nucleation. The tabular grain emulsion can contain grains of either uniform or nonuniform silver halide composition. Although the formation of grain nuclei incorporates bromide ion and only minor amounts of chloride and/or iodide ion, the low dispersity tabular grain emulsions produced at the completion of the growth step can contain in addition to bromide ions any one or combination iodide and chloride ions in any proportion found in tabular grain emulsions. Internal doping of the tabular grains, such as with Group VIII metal ions or coordination complexes, conventionally undertaken to modify properties are specifically contemplated. The dopant can be added to the reaction vessel prior to the start of precipitation, but is preferably added after the formation of twin planes during grain growth. Dopant can be added to the reaction vessel as a simple salt or as a coordination complex, such as a tetracoordination complex or, preferably, a hexacoordination complex. The ligands of the complex as well as the complexed metal ion can form a part of the completed grain. The preparation of radiographic emulsions, including the incorporation of dopants, is summarized in *Research Disclosure*, Vol. 184, Aug. 1979, Item 18431, Section I, here incorporated by reference. *Research Disclosure* and its predecessor, *Product Licensing Index*, are publications of Kenneth Mason Publications, Ltd., Emsworth, Hampshire P010 7DQ, England. Evans et al U.S. Pat. No. 5,024,931, issued Jun. 18, 1991, here incorporated by reference, discloses the effectiveness of a variety of iridium oligomers as dopants.

In optimizing the process of preparation for minimum tabular grain dispersity levels it has been observed that optimizations differ as a function of iodide incorporation in the grains as well as the choices of surfactants and/or peptizers.

While any conventional hydrophilic colloid peptizer can be employed, it is preferred to employ gelatino-peptizers during precipitation. Gelatino-peptizers are commonly divided into so-called "regular" gelatino-peptizers and so-called "oxidized" gelatino-peptizers. Regular gelatino-peptizers are those that contain naturally occurring amounts of methionine of at least 30 micromoles of methionine per gram and usually considerably higher concentrations. The term oxidized gelatino-peptizer refers to gelatino-peptizers that contain less than 30 micromoles of methionine per gram. A regular gelatino-peptizer is converted to an oxidized gelatino-peptizer when treated with a strong oxidizing agent, such as taught by Maskasky U.S. Pat. No. 4,713,323 and King et al U.S. Pat. No. 4,942,120, the disclosures of which are here incorporated by reference. The oxidizing agent attacks the divalent sulfur atom of the methionine moiety, converting it to a tetravalent or, preferably, hexavalent form. While methionine concentrations of less than 30 micromoles per gram have been found to provide oxidized gelatino-peptizer performance characteristics, it is preferred to reduce methionine concentrations to less than 12 micromoles per gram. Any efficient oxidation will generally reduce methionine to less than detectable levels. Since gelatin in rare instances naturally contains low levels of methionine, it is recognized that the terms "regular" and "oxidized" are used for convenience of expression while the true distinguishing feature is methionine level rather than whether or not an oxidation step has been performed.

When an oxidized gelatino-peptizer is employed, it is preferred to maintain a pH during twin plane formation of less than 5.2 to achieve a minimum (less than 10 percent) COV. When a regular gelatino-peptizer is employed, the pH during twin plane formation is maintained at less than 3.0 to achieve a minimum COV.

When regular gelatin and a category S-I surfactant are each employed prior to post-ripening grain growth, the category S-I surfactant is selected so that the hydrophilic block (e.g., HAO1) accounts for 4 to 96 (preferably 5 to 85 and optimally 10 to 80) percent of the total surfactant molecular weight. It is preferred that x and x′ (in formula II) be at least 6 and that the minimum molecular weight of the surfactant be at least 760 and optimally at least 1000, with maximum molecular weights ranging up to 16,000, but preferably being less than 10,000.

When the category S-I surfactant is replaced by a category S-II surfactant, the latter is selected so that the lipophilic block (e.g., LAO2) accounts for 4 to 96 (preferably 15 to 95 and optimally 20 to 90) percent of the total surfactant molecular weight. It is preferred that x (formula IV) be at least 13 and that the minimum molecular weight of the surfactant be at least 800 and optimally at least 1000, with maximum molecular weights ranging up to 30,000, but preferably being less than 20,000.

When a category S-III surfactant is selected for this step, it is selected so that the lipophilic alkylene oxide block linking unit (LOL) accounts for 4 to 96 percent, preferably 15 to 95 percent, and optimally 20 to 90 percent of the total surfactant molecular weight. In the ethylene oxide and 1,2-propylene oxide forms shown in formula (XIIIa), x can range from 3 to 250 and y can range from 2 to 340 and the minimum molecular weight of the surfactant is greater than 1,100 and optimally at least 2,000, with maximum molecular weights ranging up to 60,000, but preferably being less than 40,000. The concentration levels of surfactant are preferably restricted as iodide levels are increased.

When a category S-IV surfactant is selected for this step, it is selected so that the hydrophilic alkylene oxide block linking unit (HOL) accounts for 4 to 96 percent, preferably 5 to 85 percent, and optimally 10 to 80 percent of the total surfactant molecular weight. In the ethylene oxide and 1,2-propylene oxide forms shown in formula (XIIIb), x can range from 3 to 250 and y can range from 2 to 340 and the minimum molecular weight of surfactant is greater than 1,100 and optimally at least 2,000, with maximum molecular weights ranging up to 50,000, but preferably being less than 30,000.

When oxidized gelatino-peptizer is employed prior to post-ripening grain growth and no iodide is added during post-ripening grain growth, minimum COV emulsions can be prepared with category S-I surfactants chosen so that the hydrophilic block (e.g., HAO1) accounts for 4 to 35 (optimally 10 to 30) percent of the total surfactant molecular weight. The minimum molecular weight of the surfactant continues to be determined by the minimum values of x and x' (formula II) of 6. In optimized forms x and x' (formula II) are at least 7. Minimum COV emulsions can be prepared with category S-II surfactants chosen so that the lipophilic block (e.g., LAO2) accounts for 40 to 96 (optimally 60 to 90) percent of the total surfactant molecular weight. The minimum molecular weight of the surfactant continues to be determined by the minimum value of x (formula IV) of 13. The same molecular weight ranges for both category S-I and S-II surfactants are applicable as in using regular gelatino-peptizer as described above.

The polyalkylene oxide block copolymer surfactant can, if desired, be removed from the emulsion after it has been fully prepared. Any convenient conventional washing procedure, such as those illustrated by *Research Disclosure,* Vol. 308, December 1989, Item 308,119, Section II, can be employed. The polyalkylene oxide block copolymer surfactant constitutes a detectable component of the final emulsion when present in concentrations greater than 0.02 percent, based on the total weight of silver.

Except as otherwise indicated the remaining features of the radiographic elements can take any convenient conventional form. A summary of conventional radiographic element features is provided by *Research Disclosure,* Item 18431, cited above and here incorporated by reference. Preferred constructions of the radiographic elements as well as preferred processing are described by Dickerson et al U.S. Pat. Nos. 4,803,150 and 4,900,652, cited above and here incorporated by reference.

EXAMPLES

The invention can be better appreciated by reference to the following specific examples. In the emulsions of the examples greater than 97 percent of total grain projected area was in each instance accounted for by tabular grains. Grains having an equivalent circular diameter of less than 0.1 μm were in each instance absent or present in only such negligible amounts as to have no bearing on the numerical grain parameters reported.

Example 1 (AKT-527)

This example has as its purpose to demonstrate a tabular grain silver bromide emulsion having a very low coefficient of variation.

In a 4-liter reaction vessel was placed an aqueous gelatin solution (composed of 1 liter of water, 0.41 g of oxidized alkali-processed gelatin, 4.2 ml of 4 N nitric acid solution, 0.63 g of sodium bromide and having a pAg of 9.15, and 48.87%, based on the total weight of silver introduced, of PLURONIC TM -31R1, a surfactant satisfying formula II, x=25, x'=25, y= 7) and while keeping the temperature thereof at 45° C., 2.75 ml of an aqueous solution of silver nitrate (containing 0.37 g of silver nitrate) and 2.83 ml of an aqueous solution of sodium bromide (containing 0.23 g of sodium bromide) were simultaneously added thereto over a period of 1 minute at a constant rate. Then, into the mixture was added 19.2 ml of an aqueous sodium bromide solution (containing 1.98 g of sodium bromide) after 1 minute of mixing. Temperature of the mixture was raised to 60° C. over a period of 9 minutes. At that time, 43.3 ml of an aqueous ammoniacal solution (containing 3.37 g of ammonium sulfate and 26.7 ml of 2.5 N sodium hydroxide solution) was added into the vessel and mixing was conducted for a period of 9 minutes. Then, 94.2 ml of an aqueous gelatin solution (containing 16.7 g of oxidized alkali-processed gelatin and 10.8 ml of 4 N nitric acid solution) was added to the mixture over a period of 2 minutes. After then, 7.5 ml of an aqueous silver nitrate solution (containing 1.02 g of silver nitrate) and 8.3 ml of an aqueous sodium bromide solution (containing 0.68 g of sodium bromide) were added at a constant rate for a period of 5 minutes. Then, 474.7 ml of an aqueous silver nitrate solution (containing 129 g of silver nitrate) and equal amount of an aqueous sodium bromide solution (containing 82 g of sodium bromide) were simultaneously added to the aforesaid mixture at constant ramp starting from respective rate of 1.5 ml/min and 1.62 ml/min for the subsequent 64 minutes. Then, 253.3 ml of an aqueous silver nitrate solution (containing 68.8 g of silver nitrate) and 252 ml of an aqueous sodium bromide solution (containing 43.5 g of sodium bromide) were simultaneously added to the aforesaid mixture at constant rate over a period of 19 minutes. The silver halide emulsion thus obtained was washed.

The properties of grains of this emulsion were found to be as follows:

Average Grain ECD: 2.20 μm
Average Grain Thickness: 0.113 μm
Tabular Grain Projected Area: approx. 100%
Average Aspect Ratio of the Grains: 19.5
Average Tabularity of the Grains: 173
Coefficient of Variation of Total Grains: 4.7%

Example 2 (AKT-550)

This example has as its purpose to demonstrate a higher tabularity emulsion having a very low coefficient of variation.

In a 4-liter reaction vessel was placed an aqueous gelatin solution (composed of 1 liter of water, 0.16 g of oxidized alkali-processed gelatin, 4.2 ml of 4 N nitric acid solution, 1.12 g of sodium bromide and having a pAg of 9.39, and 99.54%, based on the total weight of silver introduced, of PLURONIC TM -31R1 as a surfactant) and while keeping the temperature thereof at 45° C., 3.33 ml of an aqueous solution of silver nitrate (containing 0.14 g of silver nitrate) and equal amount of an aqueous solution of sodium bromide (containing 0.086 g of sodium bromide) were simultaneously added thereto over a period of 1 minute at a constant rate. Then, into the mixture was added 14.2 ml of an aqueous sodium bromide solution (containing 1.46 g of sodium bromide) after 1 minute of mixing. Temperature of the mixture was raised to 60° C. over a period of 9 minutes. At that time, 32.5 ml of an aqueous ammonium solution (containing 1.68 g of ammonium sulfate and 15.8 ml of 2.5 N sodium hydroxide solution) was added into the vessel and mixing was conducted for a period of 9 minutes. Then, 88.8 ml of an aqueous gelatin solution (containing 12.5 g of oxidized alkali-processed gelatin and 5.5 ml of 4 N nitric acid solution) was added to the mixture over a period of 2 minutes. After then, 30 ml of an aqueous silver nitrate solution (containing 1.27 g of silver nitrate) and 37.8 ml of an aqueous sodium bromide solution (containing 0.97 g of sodium bromide) were added at a constant rate for a period of 15 minutes. Then, 113.3 ml of an aqueous silver nitrate solution (containing 30.8 g of silver nitrate) and 110.3 ml of an aqueous sodium bromide solution (containing 19.9 g of sodium bromide) were simultaneously added to the aforesaid mixture at constant ramp starting from respective rate of 0.67 ml/min and 0.72 ml/min for the subsequent 40 minutes. Thereafter, 7.5 ml of an aqueous sodium bromide solution (containing 1.35 g of sodium bromide) was added to the mixture. Then, 633.1 ml of an aqueous silver nitrate solution (containing 172.1 g of silver nitrate) and 612.9 ml of an aqueous sodium bromide solution (containing 110.4 g of sodium bromide) were simultaneously added to the aforesaid mixture at constant rate over a period of 71.4 minutes. The silver halide emulsion thus obtained was washed.

The properties of grains of this emulsion were found to be as follows:

Average Grain ECD: 3.70 μm
Average Grain Thickness: 0.091 μm
Tabular Grain Projected Area: approx. 100%
Average Aspect Ratio of the Grains: 40.7
Average Tabularity of the Grains: 447
Coefficient of Variation of Total Grains: 9%

Example 3 (AKT-615)

The purpose of this example is to demonstrate a silver bromoiodide emulsion prepared with iodide run in during post-ripening growth step and exhibiting a very low COV.

In a 4-liter reaction vessel was placed an aqueous gelatin solution (composed of 1 liter of water, 1.3 g of alkali-processed gelatin, 4.2 ml of 4 N nitric acid solution, 2.44 g of sodium bromide and having pAg of 9.71, and 2.76%, based on the total weight of silver introduced, of PLURONIC TM -17R1, a surfactant satisfying formula II, x=15, x'=15, y=4) and while keeping the temperature thereof at 45° C., 13.3 ml of an aqueous solution of silver nitrate (containing 1.13 g of silver nitrate) and equal amount of an aqueous solution of sodium bromide (containing 0.69 g of sodium bromide) were simultaneously added thereto over a period of 1 minute at a constant rate. Then, into the mixture was added 14.2 ml of an aqueous sodium bromide solution (containing 1.46 g of sodium bromide) after 1 minute of mixing. Temperature of the mixture was raised to 60° C. over a period of 9 minutes. At that time, 33.5 ml of an aqueous ammoniacal solution (containing 1.68 g of ammonium sulfate and 16.8 ml of 2.5 N sodium hydroxide solution) was added into the vessel and mixing was conducted for a period of 9 minutes. Then, 88.8 ml of an aqueous gelatin solution (containing 16.7 g of alkali-processed gelatin and 5.5 ml of 4 N nitric acid solution) was added to the mixture over a period of 2 minutes. After then, 83.3 ml of an aqueous silver nitrate solution (containing 22.64 g of silver nitrate) and 78.7 ml of an aqueous halide solution (containing 12.5 g of sodium bromide and 2.7 g of potassium iodide) were added at a constant rate for a period of 40 minutes. Then, 299 ml of an aqueous silver nitrate solution (containing 81.3 g of silver nitrate) and 284.1 ml of an aqueous halide solution (containing 45 g of sodium bromide and 9.9 g of potassium iodide) were simultaneously added to the aforesaid mixture at constant ramp starting from respective rate of 2.08 ml/min and 2.05 ml/min for the subsequent 35 minutes. Then, 349 ml of an aqueous silver nitrate solution (containing 94.9 g of silver nitrate) and 330 ml of an aqueous halide solution (containing 52.3 g of sodium bromide and 11.5 g of potassium iodide) were simultaneously added to the aforesaid mixture at constant rate over a period of 23.3 minutes. The silver halide emulsion thus obtained contained 12.4 mole % of iodide.

The properties of grains of this emulsion were found to be as follows:

Average Grain ECD: 1.10 μm
Average Grain Thickness: 0.211 μm
Tabular Grain Projected Area: approx. 100%
Average Aspect Ratio of the Grains: 5.2
Average Tabularity of the Grains: 24.6
Coefficient of Variation of Total Grains: 8.2%

Example 4 (MK-92)

The purpose of this example is to demonstrate a very low coefficient of variation silver bromoiodide emulsion prepared by dumping iodide into the reaction vessel during the post-ripening grain growth step.

In a 4-liter reaction vessel was placed an aqueous gelatin solution having a pAg of 9.72 composed of 1 liter of water, 1.3 g of alkali-processed gelatin, 4.2 ml of 4 N nitric acid solution, 2.5 g of sodium bromide, and PLURONIC TM -31R1, a surfactant which satisfies formula II, x=25, x'=25, y=7. The surfactant constituted 15.76 percent by weight of the total silver introduced up to the beginning of the post-ripening grain growth step. While keeping the temperature thereof at 40° C., 13.3 ml of an aqueous solution of silver nitrate (containing 1.13 g of silver nitrate) and equal amount of an aqueous halide solution (containing 0.69 g of sodium bromide and 0.0155 g of potassium iodide) were simultaneously added thereto over a period of 1 minute at a constant rate. Then, into the mixture was added 14.2 ml of an aqueous sodium bromide solution (containing 1.46 g of sodium bromide) after 1 minute of mixing. Temperature of the mixture was raised to 50° C. over a period of 6 minutes after 1 minute of mixing. Thereafter, 32.5 ml of an aqueous ammoniacal solution (containing 1.68 g of ammonium sulfate and 15.8 ml of 2.5 N sodium hydroxide solution) was added into the vessel and mixing was conducted for a period of 9 minutes. Then, 83.3 ml of an aqueous gelatin solution (containing 25.0 g of alkali-processed gelatin and 5.5 ml of 4 N nitric acid solution) were added to the mixture over a period of 2 minutes. After then, 83.3 ml of an aqueous silver nitrate solution (containing 22.64 g of silver nitrate) and 84.7 ml of an aqueous halide solution (containing 14.5 g of sodium bromide and 0.236 g of potassium iodide) were added at a constant rate for a period of 40 minutes. Then, 299 ml of an aqueous silver nitrate solution (containing 81.3 g of silver nitrate) and 298 ml of an aqueous halide solution (containing 51 g of sodium bromide and 0.831 g of potassium iodide) were simultaneously added to the aforesaid mixture at constant ramp starting from respective rate of 2.08 ml/min and 2.12 ml/min for the subsequent 35 minutes. Then, 128 ml of an aqueous silver nitrate solution (containing 34.8 g of silver nitrate) and 127 ml of an aqueous halide solution (containing 21.7 g of sodium bromide and 0.354 g of potassium iodide) were simultaneously added to the aforesaid mixture at constant rate over a period of 8.5 minutes. An iodide solution in the amount of 125 cc containing 3.9 g potassium iodide was added at rate of 41.7 cc/min for 3 minutes followed by a 2 minute hold under unvaried conditions. Thereafter, 221 ml of an aqueous silver nitrate solution (containing 60 g of silver nitrate) and equal amount of an aqueous halide solution (containing 38.2 g of sodium bromide) were simultaneously added to the aforesaid mixture at a constant rate over a period of 16.6 minutes. The silver halide emulsion thus obtained contained 2.7 mole of iodide.

The properties of grains of this emulsion were found to be as follows:

Average Grain ECD: 0.65 μm
Average Grain Thickness: 0.269 μm
Tabular Grain Projected Area: approx. 100%
Average Aspect Ratio of the Grains: 2.4
Average Tabularity of the Grains: 9
Coefficient of Variation of Total Grains: 9.9%

Example 5 (AKT-711D)

The purpose of this example is to illustrate a process of tabular grain emulsion preparation that results in a small average ECD and a very low COV.

In a 4-liter reaction vessel was placed an aqueous gelatin solution (composed of 1 liter of water, 0.83 g of oxidized alkali-processed gelatin, 3.8 ml of 4 N nitric acid solution, 1.12 g of sodium bromide and having pAg of 9.39, and 7.39 wt. %, based on total silver used in nucleation, of PLURONIC TM -31R1 surfactant) and while keeping the temperature thereof at 45° C., 10.67 ml of an aqueous solution of silver nitrate (containing 1.45 g of silver nitrate) and equal amount of an aqueous solution of sodium bromide (containing 0.92 g of sodium bromide) were simultaneously added thereto over a period of 1 minute at a constant rate. Then, into the mixture was added 14.2 ml of an aqueous sodium bromide solution (containing 1.46 g of sodium bromide) after 1 minute of mixing. Temperature of the mixture was raised to 60° C. over a period of 9 minutes. At that time, 43.3 ml of an aqueous ammoniacal solution (containing 3.36 g of ammonium sulfate and 26.7 ml of 2.5 N sodium hydroxide solution) was added into the vessel and mixing was conducted for a period of 9 minutes. Then, 178 ml of an aqueous gelatin solution (containing 16.7 g of oxidized alkali-processed gelatin, 11.3 ml of 4 N nitric acid solution and 0.11 g of Pluronic TM -31R1 surfactant) was added to the mixture over a period of 2 minutes. After then, 7.5 ml of an aqueous silver nitrate solution (containing 1.02 g of silver nitrate) and 7.7 ml of an aqueous sodium bromide solution (containing 0.66 g of sodium bromide) were added at a constant rate for a period of 5 minutes. Then, 79.6 ml of an aqueous silver nitrate solution (containing 21.6 g of silver nitrate) and an equal amount of an aqueous sodium bromide solution (containing 82 g of sodium bromide) were simultaneously added to the aforesaid mixture at constant ramp starting from respective rate of 1.5 ml/min and 1.62 ml/min for the subsequent 22.3 minutes. The silver halide emulsion thus obtained was washed.

The properties of grains of this emulsion were found to be as follows:

Average Grain ECD: 0.48 μm
Average Grain Thickness: 0.088 μm
Tabular Grain Projected Area: approx. 100%
Average Aspect Ratio of the Grains: 5.5
Average Tabularity of the Grains: 62
Coefficient of Variation of Total Grains: 9.6%

Examples 6 and 7

The purpose of these examples is to demonstrate the effect of a category S-I surfactant on achieving a low level of dispersity.

Example 6 (a control) (AKT-702)

In a 4-liter reaction vessel was placed an aqueous gelatin solution (composed of 1 liter of water, 1.3 g of oxidized alkali-processed gelatin, 4.2 ml of 4 N nitric acid solution, 0.035 g of sodium bromide and having a pAg of 7.92) and while keeping the temperature thereof at 45° C., 13.3 ml of an aqueous solution of silver nitrate (containing 1.13 g of silver nitrate) and a balancing molar amount of an aqueous solution of sodium bromide and sodium iodide (containing 0.677 g of sodium bromide and 0.017 g of sodium iodide) were simultaneously added thereto over a period of 1 minute at a constant rate. Then, into the mixture was added 24.2 ml of an aqueous sodium bromide solution (containing 2.49 g of sodium bromide) after 1 minute of mixing. Temperature of the mixture was raised to 60° C. over a period of 9 minutes. At that time, 33.5 ml of an aqueous ammoniacal solution (containing 1.68 g of ammonium sulfate and 16.8 ml of 2.5 N sodium hydroxide solution) was added into the vessel and mixing was conducted for a period of 9 minutes. Then, 88.8 ml of an aqueous gelatin solution (containing 16.7 g of oxidized alkali-processed gelatin and 5.5 ml of 4 N nitric acid solution) was added to the mixture over a period of 2 minutes. After then, 83.3 ml of an aqueous silver nitrate solution (containing 22.64 g of silver nitrate) and 81.3 ml of an aqueous sodium bromide solution (containing 14.6 g of sodium bromide) were added at a constant rate for a period of 40 minutes. Then, 299 ml of an aqueous silver nitrate solution (containing 81.3 g of silver nitrate) and 285.3 ml of an aqueous sodium bromide solution (containing 51.4 g of sodium bromide) were simultaneously added to the aforesaid mixture at constant ramp starting from respective rate of 2.08 ml/min and 2.07 ml/min for the subsequent 64 minutes. Then, 349 ml of an aqueous silver nitrate solution (containing 94.9 g of silver nitrate) and 331.9 ml of an aqueous sodium bromide solution (containing 59.8 g of sodium bromide) were simultaneously added to the aforesaid mixture at constant rate over a period of 23.3 minutes. The silver halide emulsion thus obtained was washed.

The properties of grains of this emulsion were found to be as follows:

Average Grain ECD: 4.80 μm
Average Grain Thickness: 0.086 μm
Tabular Grain Projected Area: approx. 100%
Average Aspect Ratio of the Grains: 55.8
Average Tabularity of the Grains: 649
Coefficient of Variation of Total Grains: 36.1%

Example 7 (AKT-244)

Example 6 was repeated, except that PLURONIC TM -31R1, a surfactant satisfying formula II, $x=25$, $x'=25$, $y=7$, was additionally present in the reaction vessel prior to the introduction of silver salt. The surfactant constituted of 12.28 percent by weight of the total silver introduced up to the beginning of the post-ripening grain growth step.

The properties of the grains of this emulsion were found to be as follows:

Average Grain ECD: 1.73 μm
Average Grain Thickness: 0.093 μm
Tabular Grain Projected Area: approx. 100%
Average Aspect Ratio of the Grains: 18.6
Average Tabularity of the Grains: 200
Coefficient of Variation of Total Grains: 7.5%

Example 8 (AKT-612)

The purpose of this example is to illustrate the preparation of a very low coefficient of variation tabular grain emulsion employing a category S-II surfactant.

In a 4-liter reaction vessel was placed an aqueous gelatin solution (composed of 1 liter of water, 1.3 g of alkali-processed gelatin, 4.2 ml of 4 N nitric acid solution, 2.44 g of sodium bromide and having a pAg of 9.71 and 1.39 wt %, based on total silver used in nucleation, of PLURONIC TM -L63, a surfactant satisfying formula IV, x=32, y=9, y'=9) and while keeping the temperature thereof at 45° C., 13.3 ml of an aqueous solution of silver nitrate (containing 1.13 g of silver nitrate) and equal amount of an aqueous solution of sodium bromide (containing 0.69 g of sodium bromide) were simultaneously added thereto over a period of 1 minute at a constant rate. Thereafter, after 1 minute of mixing, the temperature of the mixture was raised to 60° C. over a period of 9 minutes. At that time, 33.5 ml of an aqueous ammoniacal solution (containing 1.68 g of ammonium sulfate and 16.8 ml of 2.5 N sodium hydroxide solution) was added into the vessel and mixing was conducted for a period of 9 minutes. Then, 88.8 ml of an aqueous gelatin solution (containing 16.7 g of alkali-processed gelatin and 5.5 ml of 4 N nitric acid solution) was added to the mixture over a period of 2 minutes. After then, 83.3 ml of an aqueous silver nitrate solution (containing 22.64 g of silver nitrate) and 80 ml of an aqueous halide solution (containing 14 g of sodium bromide and 0.7 g of potassium iodide) were added at a constant rate for a period of 40 minutes. Then, 299 ml of an aqueous silver nitrate solution (containing 81.3 g of silver nitrate) and 285.3 ml of an aqueous halide solution (containing 49.8 g of sodium bromide and 2.5 g of potassium iodide) were simultaneously added to the aforesaid mixture at constant ramp starting from respective rate of 2.08 ml/min and 2.07 ml/min for the subsequent 35 minutes. Then, 349 ml of an aqueous silver nitrate solution (containing 94.9 g of silver nitrate) and 331.1 ml of an aqueous halide solution (containing 57.8 g of sodium bromide and 2.9 g of potassium iodide) were simultaneously added to the aforesaid mixture at constant rate over a period of 23.3 minutes. The silver halide emulsion thus obtained contained 3.1 mole % of iodide. The emulsion was then washed.

The properties of grains of this emulsion were found to be as follows:

Average grain ECD: 1.14 μm
Average Grain Thickness: 0.179 μm
Tabular Grain Projected Area: approx. 100%
Average Aspect Ratio of the Grains: 6.4
Average Tabularity of the Grains: 35.8
Coefficient of Variation of Total Grains: 6.0%

Examples 9 and 10

The purpose of these examples is to demonstrate the effectiveness of a category S-III surfactant in achieving a very low level of dispersity in a tabular grain emulsion.

Example 9 (a control) (MK-103)

No surfactant was employed.

In a 4-liter reaction vessel was placed an aqueous gelatin solution (composed of 1 liter of water, 1.3 g of alkali-processed gelatin, 4.2 ml of 4 N nitric acid solution, 2.5 g of sodium bromide and having a pAg of 9.72) and while keeping the temperature thereof at 45° C., 13.3 ml of an aqueous solution of silver nitrate (containing 1.13 g of silver nitrate) and equal amount of an aqueous solution of sodium bromide (containing 0.69 g of sodium bromide) were simultaneously added thereto over a period of 1 minute at a constant rate. Then, into the mixture was added 14.2 ml of an aqueous sodium bromide solution (containing 1.46 g of sodium bromide) after 1 minute of mixing. Temperature of the mixture was raised to 60° C. over a period of 9 minutes after 1 minute of mixing. Thereafter, 32.5 ml of an aqueous ammoniacal solution (containing 1.68 g of ammonium sulfate and 15.8 ml of 2.5 N sodium hydroxide solution) was added into the vessel and mixing was conducted for a period of 9 minutes. Then, 172.2 ml of an aqueous gelatin solution (containing 41.7 g of alkali-processed gelatin and 5.5 ml of 4 N nitric acid solution) was added to the mixture over a period of 2 minutes. After then, 83.3 ml of an aqueous silver nitrate solution (containing 22.64 g of silver nitrate) and 84.7 ml of an aqueous halide solution (containing 14.2 g of sodium bromide and 0.71 g of potassium iodide) were added at a constant rate for a period of 40 minutes. Then, 299 ml of an aqueous silver nitrate solution (containing 81.3 g of silver nitrate) and 298 ml of an aqueous halide solution (containing 50 g of sodium bromide and 2.5 g of potassium iodide) were simultaneously added to the aforesaid mixture at constant ramp starting from respective rate of 2.08 ml/min and 2.12 ml/min for the subsequent 35 minutes. Then, 128 ml of an aqueous silver nitrate solution (containing 34.8 g of silver nitrate) and 127 ml of an aqueous halide solution (containing 21.3 g of sodium bromide and 1.07 g of potassium iodide) were simultaneously added to the aforesaid mixture at constant rate over a period of 8.5 minutes. Thereafter, 221 ml of an aqueous silver nitrate solution (containing 60 g of silver nitrate) and equal amount of an aqueous sodium bromide solution (containing 37.1 g of sodium bromide and 1.85 g of potassium iodide) were simultaneously added to the aforesaid mixture at constant rate over a period of 16.6 minutes. The silver halide emulsion thus obtained contained 3 mole % of iodide.

The properties of grains of this emulsion were found to be as follows:

Average Grain ECD: 1.81 μm
Average Grain Thickness: 0.122 μm
Tabular Grain Projected Area: approx. 100%
Average Aspect Ratio of the Grains: 14.8
Average Tabularity of the Grains: 121
Coefficient of Variation of Total Grains: 29.5%.

Example 10 (MK-162)

Example 9 was repeated, except that

TETRONIC TM-1508,
N, N, N', N' -tetrakis{$H(OCH_2CH_2)_y[OCH(CH_3)CH_2-]_x$}
ethylenediamine surfactant, x=26, y=136, was additionally present in the reaction vessel prior to the introduction of silver salt. The surfactant constituted of 11.58 percent by weight of the total silver introduced prior to the post-ripening grain growth step.

The properties of grains of this emulsion were found to be as follows:

Average Grain ECD: 1.20 μm
Average Grain Thickness: 0.183 μm
Tabular Grain Projected Area: approx. 100%

Average Aspect Ratio of the Grains: 6.6
Average Tabularity of the Grains: 36.1
Coefficient of Variation of Total Grains: 9.1% From viewing the reflectances of the tabular grains of the emulsions of Examples 9 and 10 it was apparent that the Example 10 tabular grain exhibited significantly less grain to grain variations in thickness.

Example 11 (MK-179)

The purpose of this example is to demonstrate the effectiveness of a category S-IV surfactant in achieving a very low level of dispersity in a tabular grain emulsion.

Example 10 was repeated, except that

TETRONIC ™-150R8,
N, N, N', N' -tetrakis{$H(OCH(CH_3)CH_2]_x(OCH_2CH_2)_y$-}
ethylenediamine surfactant, x=18, y=92, was additionally present in the reaction vessel prior to the introduction of silver salt. The surfactant constituted 2.32 percent by weight of the total silver introduced prior to the post-ripening grain growth step.

The properties of grains of this emulsion were found to be as follows:

Average Grain ECD: 1.11 μm
Average Grain Thickness: 0.255 μm
Tabular Grain Projected Area: approx. 100%
Average Aspect Ratio of the Grains: 4.4
Average Tabularity of the Grains: 17

Example 12 (MAT-002)

In a 4-liter reaction vessel was placed an aqueous gelatin solution (composed of 1 liter of water, 0.83 g of oxidized alkali-processed gelatin, 4.2 ml of 4 N nitric acid solution, 1.12 g of sodium bromide and having pAg of 9.39, and 14.77 wt. %, based on total silver used in nucleation, of PLURONIC TM -31R1 surfactant) and while keeping the temperature thereof at 45° C., 5.33 ml of an aqueous solution of silver nitrate (containing 0.72 g of silver nitrate) and equal amount of an aqueous solution of sodium bromide (containing 0.46 g of sodium bromide) were simultaneously added thereto over a period of 1 minute at a constant rate. Then, into the mixture was added 14.2 ml of an aqueous sodium bromide solution (containing 1.46 g of sodium bromide) after 1 minute of mixing. The temperature of the mixture was raised to 60° C. over a period of 9 minutes. At that time, 46.0 ml of an aqueous ammoniacal solution (containing 3.36 g of ammonium sulfate and 29.4 ml of 2.5 N sodium hydroxide solution) was added into the vessel and mixing was conducted for a period of 9 minutes. Then, 180 ml of an aqueous gelatin solution (containing 16.7 g of oxidized alkali-processed gelatin, 13.1 ml of 4 N nitric acid solution and 0.11 g of Pluronic TM -31R1 surfactant) was added to the mixture over a period of 2 minutes. After then, 7.5 ml of an aqueous silver nitrate solution (containing 1.02 g of silver nitrate) and 7.7 ml of an aqueous sodium bromide solution (containing 0.66 g of sodium bromide) were added at a constant rate for a period of 5 minutes. Then, 474.7 ml of an aqueous silver nitrate solution (containing 129 g of silver nitrate) and 474.1 ml of an aqueous sodium bromide solution (containing 82 g of sodium bromide) were simultaneously added to the aforesaid mixture at constant ramp starting from respective rate of 1.5 ml/min and 1.62 ml/min for the subsequent 64 minutes. Then, 253.3 ml of an aqueous silver nitrate solution (containing 68.8 g of silver nitrate) and 251.1 ml of an aqueous sodium bromide solution (containing 43.4 g of sodium bromide) were simultaneously added to the aforesaid mixture at constant rate over a period of 19 minutes. The silver halide emulsion thus obtained was washed.

The properties of grains of this emulsion were found to be as follows:

Average Grain ECD: 1.77 μm
Average Grain Thickness: 0.108 μm
Tabular Grain Projected Area: approx. 100%
Average Aspect Ratio of the Grains: 12.4
Average Tabularity of the Grains: 87
Coefficient of Variation of Total Grains: 4.7%

Radiographic Elements

A control dual coated radiographic element was constructed as described in Examples 1-6 of Dickerson et al U.S. Pat. No. 4,900,652. The crossover reducing dye (Dye 56) was coated beneath each emulsion layer unit at a coverage of 1.4 mg/dm$^2$. Each emulsion layer unit was coated at a coverage of 24.2 mg/dm$^2$ silver and 32.3 mg/dm$^2$ gelatin. The emulsion was a high tabularity tabular grain silver bromide emulsion having a mean grain diameter of 1.8 μm. Tabular grains having a thickness of 0.13 μm and a mean diameter of at least 0.6 μm exhibited a mean tabularity of 70.3 and accounted for 70 percent of the total grain projected area. The COV of the total grain population was 33.6%.

A second radiographic element satisfying the requirements of the invention was identically constructed, except that the emulsion of Example 12 was substituted for the emulsion in each emulsion layer unit of the control radiographic element. The radiographic elements were otherwise identical.

Intensifying Screens

Each of the radiographic elements were placed between a pair of intensifying screens to form an assembly similar to that shown in FIG. 2. The screens each had a composition and structure corresponding to that of a commercial, general purpose intensifying screen. Each screen consisted of a terbium activated gadolinium oxysulfide phosphor having a median particle size of 7 μm coated on a white pigmented polyester support in a Permuthane TM polyurethane binder at a total phosphor coverage of 7.0 mg/dm$^2$ at a phosphor to binder ratio of 15:1.

Radiographic Exposures

The above assemblies were in each instance exposed as follows:

The assemblies were exposed to 70 KVp X-radiation, varying either current (mA) or time, using a 3-phase Picker Medical (Model VTX-650 TM X-ray unit containing filtration up to 3 mm of aluminum. Sensitometric gradations in exposure were achieved by using a 21-increment (0.1 log E) aluminum step wedge of varying thickness.

Processing

The films were processed at 35° C. in a commercially available Kodak RP X-Omat (Model 6B) TM rapid access process in 90 seconds as follows:

| | |
|---|---|
| development | 24 seconds at 35° C., |
| fixing | 20 seconds at 35° C., |

-continued

| | |
|---|---|
| washing | 10 seconds at 35° C., and |
| drying | 20 seconds at 65° C., |

where the remaining time is taken up in transport between processing steps. The development step employs the following developer:

| | |
|---|---|
| Hydroquinone | 30 g |
| 1-Phenyl-3-pyrazolidone | 1.5 g |
| KOH | 21 g |
| $NaHCO_3$ | 7.5 g |
| $Na_2S_2O_5$ | 12.6 g |
| NaBr | 35 g |
| 5-Methylbenzotriazole | 0.06 g |
| Glutaraldehyde | 4.9 g |
| Water to 1 liter at pH 10.0 and the fixing step employs the following fixing composition: | |
| Ammonium thiosulfate, 60% | 260.0 g |
| Sodium Bisulfite | 180.0 g |
| Boric acid | 25.0 g |
| Acetic acid | 10.0 g |
| Aluminum sulfate | 8.0 g |
| Water to 1 liter at pH 3.9 to 4.5 | |

Sensitometry

Optical densities are expressed in terms of diffuse density as measured by an X-rite Model 310 TM densitometer, which was calibrated to ANSI standard PH 2.19 and was traceable to a National Bureau of Standards calibration step tablet. The characteristic curve (density vs. log E) was plotted for each radiographic element processed. Speed, reported in relative log units, was measured at 1.0 above minimum density.

TABLE XVI

| Radiographic Element | Speed | Relative Density Max. | Relative Density Min. |
|---|---|---|---|
| Control | 100 | 3.6 | 0.23 |
| Invention | 100 | 3.7 | 0.23 |

Detective Quantum Efficiencies

The DQE of each radiographic element was determined as the ratio of its input noise power spectrum divided by the output noise power spectrum. These were determined in the following manner:

Input Noise Power Spectrum

X-radiation noise power spectrum (NPSi) exposures were performed using a tungsten target X-ray tube (12° target angle) driven by a three phase, twelve pulse generator operated at 70 kVp with 0.5 mm copper and 1 mm aluminum added filtration with a calculated half-value layer of 6.4 mm aluminum. X-ray exposure values were measured using calibrated air ionization chambers (RADICAL TM models 10X5-60, 20X5-6). These exposure values were converted to incident quantum fluence using a conversion factor determined from the half-value layer and the calculated relationship between quantum fluence per unit exposure and half-value layer for appropriate published X-ray spectra (R. Birch, M. Marshall, and G. M. Ardan, *Catalogue of Spectral Data for Diagnostic X-rays*, Hospital Physicists Association of England, 1979). The procedure is described by P. C. Bunch and K. E. Huff, *Signal-to-Noise Ratio Measurements on Two High-Resolution Screen-Film Systems*, Proc. Soc. Photoopt. Instrum. Eng., 555, 68–83 (1985).

Output Noise Power Spectrum

A continuous area of film, 8.192 cm×9.728 cm, was scanned with the 0.02 mm by 0.76 mm microdensitometer aperture, yielding 128 raster of 4096 points each. To minimize the effects of aliasing, a low pass, 4 pole Butterworth TM electronic filter with the 3dB point set to the Nyquist frequency for the scan was inserted into the analog signal line of the microdensitometer. From these data, an effective scanning slit, 12.16 mm by 0.02 mm, was synthesized. The resulting 128 slit synthesized 256 point blocks were used to estimate the output noise power spectrum (NPSo). The algorithm used is summarized in a recent publication, P. C. Bunch, K. E. Huff, and R. VanMetter, *Analysis of the Detective Quantum Efficiency of a Radiographic Screen-Film Combination*, *J. Opt. Soc. Am. A*, 4, 902–909 (1987).

DOE Advantage

The detective quantum efficiencies of the control radiographic element and that of the radiographic element of the invention were compared at a density 1.0 at spatial frequencies ranging from 1 to 7 cycles/mm. The results are summarized in Table XVII:

TABLE XVII

| Spat. Freq Cycl./mm | Detective Quantum Efficiencies DQE Invention | DQE Control | Rel. DQE Inv./Cont. |
|---|---|---|---|
| 1.0 | 0.25982 | 0.20642 | 1.25087 |
| 2.0 | 0.15458 | 0.12440 | 1.24260 |
| 3.0 | 0.08245 | 0.06360 | 1.29638 |
| 4.0 | 0.04689 | 0.03930 | 1.19313 |
| 5.0 | 0.02611 | 0.02090 | 1.24928 |
| 6.0 | 0.01566 | 0.01268 | 1.23502 |
| 7.0 | 0.00887 | 0.00787 | 1.12706 |

The radiographic element of the invention exhibited a higher detective quantum efficiency than the control at all observed spatial frequencies.

The invention has been described in detail with particular reference to preferred embodiments thereof, but it will be understood that variations and modifications can be effected within the spirit and scope of the invention.

What is claimed is:

1. A radiographic element comprised of a film support capable of transmitting radiation to which said radiographic element is responsive having opposed major surfaces, and, coated on said opposed major surfaces, emulsion layer units comprised of spectrally sensitized silver halide tabular grains having an average tabularity of greater than 25, where the tabularity of each tabular grain is the ratio of its equivalent circular diameter in micrometers divided by the square of its thickness in micrometers, and, interposed between each of said emulsion layer units and said support, means for absorbing radiation to which said emulsion layer units are responsive, CHARACTERIZED IN THAT each of said emulsion layer units exhibit a coefficient of variation of less than 15 percent, based on their total grain population having an equivalent circular diameter of greater than 0.1 μm, greater than 97 percent of the projected area of the grain population having an equivalent circular diameter of greater than 0.1 μm being accounted for by tabular grains having a mean thickness of less than 0.3 μm and a halide content of from 0 to 5 mole percent chloride, from 0 to 5 mole percent iodide, and from 90 to 100 mole percent bromide, based on total silver.

2. A radiographic element according to claim 1 further characterized in that the radiographic element exhibits a crossover of less than 10 percent.

3. A radiographic element according to claim 2 further characterized in that the radiographic element exhibits a crossover of less than 5 percent.

4. A radiographic element according to claim 1 further characterized in that the tabular grains have an average aspect ratio of up to 100.

5. A radiographic element according to claim 4 further characterized in that the tabular grains have an average aspect ratio in the range of from 10 to 60.

6. A radiographic element according to claim 1 further characterized in that said emulsion layer units exhibit a coefficient of variation of less than 10 percent, based on their total grain population having an equivalent circular diameter of greater than 0.1 μm.

7. A radiographic element according to claim 1 further characterized in that the tabular grains are silver bromide grains.

8. A radiographic element according to claim 1 further characterized in that the tabular grains are silver bromoiodide grains.

9. A radiographic element according to claim 8 further characterized in that the tabular grains contain less than 5 mole percent iodide.

10. A radiographic element according to claim 9 further characterized in that the tabular grains contain less than 3 mole percent iodide.

11. A radiographic element according to claim 1 further characterized in that at least one polyalkylene oxide block copolymer capable of reducing tabular grain dispersity is present.

12. A radiographic element comprised of a film support capable of transmitting radiation to which said radiographic element is responsive having opposed major surfaces, and, coated on said opposed major surfaces, emulsion layer units comprised of spectrally sensitized silver halide tabular grains having an average tabularity of greater than 25, where the tabularity of each tabular grain is the ratio of its equivalent circular diameter in micrometers divided by the square of its thickness in micrometers, and, interposed between each of said emulsion layer units and said support, means for absorbing radiation to which said emulsion layer units are responsive, CHARACTERIZED IN THAT each of said emulsion layer units (a) contain a polyalkylene oxide block copolymer selected to satisfy one of the formulae (S-I)

LAO1-HAO1-LAO1 and

HAO2-LAO2-HAO2 where

LAO1 in each occurrence represents a terminal lipophilic alkylene oxide block unit, HAO2 in each occurrence presents a terminal hydrophilic alkylene oxide block unit, HAO1 represents a hydrophilic alkylene oxide block linking unit, LAO2 represents a lipophilic alkylene oxide block linking unit, each block linking unit constitutes from 4 to 96 percent of the block copolymer on a weight basis, the block copolymer S-I has a molecular weight of from 760 to less than 16,000, and the block copolymer S-II has a molecular weight of from 1,000 to 30,000 and (b) exhibit a coefficient of variations of less than 15 percent, based on their total grain population having an equivalent circular diameter of greater than 0.1 μm, greater than 97 percent of the projected area of the grain population having an equivalent circular diameter of greater than 0.1 μm being accounted for by tabular grains having a mean thickness of less than 0.3 μm and a halide content of from 0 to 5 mole percent chloride, from 0 to 5 mole percent iodide, and from 90 to 100 percent bromide, based on total silver.

13. A radiographic element according to claim 12 further characterized in that the polyalkylene oxide block copolymer satisfies the formula:

$$HO-(\overset{CH_3}{\overset{|}{C}}HCH_2O)_x-(CH_2CH_2O)_y-(CH_2\overset{CH_3}{\overset{|}{C}}HO)_{x'}-H$$

where x and x′ are each in the range of from 6 to 120 and y is in the range of from 2 to 300.

14. A radiographic element according to claim 12 further characterized in that the polyalkylene oxide block copolymer satisfies the formula:

$$HO-(CH_2CH_2O)_{y'}-(\overset{CH_3}{\overset{|}{C}}HCH_2O)_x-(CH_2CH_2O)_{y'}-H$$

where x is in the range of from 13 to 490 and y and y′ are in the range of from 1 to 320.

15. A radiographic element comprised of a film support capable of transmitting radiation to which said radiographic element is responsive having opposed major surfaces, and coated on said opposed major surfaces, emulsion layer units comprised of spectrally sensitized silver halide tabular grains having an average tabularity of greater than 25, where the tabularity of each tabular grain is the ratio of its equivalent circular diameter in micrometers divided by the square of its thickness in micrometers, and, interposed between each of said emulsion layer units and said support, means for absorbing radiation to which said emulsion layer units are responsive, CHARACTERIZED IN THAT each of said emulsion layer units (a) contain a polyalkylene oxide block copolymer selected to satisfy one of the formulae (S-III)

$(H\text{-}HAO3)_2\text{-}LOL\text{-}(HAO3\text{-}H)_{2'}$ and

-continued $$(H\text{-}LAO4)_z\text{-}HOL\text{-}(LAO4\text{-}H)_{z'}$$

where

LAO4 in each occurrence represents a terminal lipophilic alkylene oxide block unit, HAO3 in each occurrence presents a terminal hydrophilic alkylene oxide block unit, HOL represents a hydrophilic alkylene oxide block linking unit, LOL represents a lipophilic alkylene oxide block linking unit, z is 2, and z' is 1 or 2, each block linking unit constitutes from 4 to 96 percent of the block copolymer on a weight basis, the block copolymer S-III has a molecular weight of from 1,100 to 60,000, and the block copolymer S-IV has a molecular weight of from 1,100 to 50,000 and (b) exhibit a coefficient of variation of less than 15 percent, based on their total grain population having an equivalent circular diameter of greater than 0.1 μm, greater than 97 percent of the projected area of the grain population having an equivalent circular diameter of greater than 0.1 μm being accounted for by tabular grains having a mean thickness of less than 0.3 μm and a halide content of from 0 to 5 mole percent chloride, from 0 to 5 mole percent iodide, and from 90 to 100 mole percent bromide, based on total silver.

16. A radiographic element according to claim 12 or 15 further characterized in that (a) each lipophilic alkylene oxide block contains repeating units satisfying the formula:

$$-(OCH\overset{R^9}{\overset{|}{C}}H_2)-$$

where $R^9$ is a hydrocarbon containing from 1 to 10 carbon atoms, and (b) each hydrophilic alkylene oxide block contains repeating units satisfying the formula:

$$-(OCH\overset{R^{10}}{\overset{|}{C}}H_2)-$$

where $R^{10}$ is hydrogen or a hydrocarbon containing from 1 to 10 carbon atoms substituted with at least one polar substituent.

17. A radiographic element comprised of a film support capable of transmitting radiation to which said radiographic element is responsive having opposed major surfaces, and, coated on said opposed major surfaces, emulsion layer units comprised of a vehicle and spectrally sensitized silver halide tabular grains having an average tabularity of greater than 25, where the tabularity of each tabular grain in the ratio of its equivalent circular diameter in micrometers divided by the square of its thickness in micrometers, and, interposed between each of said emulsion layer units and said support, means for reducing crossover of radiation to which said emulsion layer units are responsive to less than 10 percent,

CHARACTERIZED IN THAT each of said emulsion layer units exhibit a coefficient of variation of less than 10 percent, based on their total grain population having an equivalent circular diameter of greater than 0.1 μm, greater than 97 percent of the projected area of the total grain population having an equivalent circular diameter of greater than 0.1 μm being accounted for by tabular grains having a mean thickness of less than 0.3 μm and a halide content of bromide and from 0 to 5 mole percent iodide, based on total silver and the vehicle is comprised of a gelatino-peptizer containing at least 30 micromoles per gram of methionine and a polyalkylene oxide block copolymer surfactant having a molecular weight in the range of from 760 to 16,000 satisfying the formula:

LAO1—HAO1—LAO1 where

LAO1 in each occurrence represents a terminal lipophilic alkylene oxide block unit containing at least six $—CH(CH_3)CH_2O—$ repeating units and HAO1 represents a hydrophilic alkylene oxide block linking unit containing $—CH_2CH_2O—$ repeating units forming 5 to 85 percent of the total surfactant molecular weight.

18. A radiographic element according to claim 17 further characterized in that the polyalkylene oxide block copolymer surfactant has a molecular weight in the range of from 1000 to 10,000, LAO1 in each occurrence contains at least seven $—CH(CH_3)CH_2O—$ repeating units, and HAO1 forms from 10 to 80 percent of the total surfactant molecular weight.

19. A radiographic element comprised of a film support capable of transmitting radiation to which said radiographic element is responsive having opposed major surfaces, and, coated on said opposed major surfaces, emulsion layer units comprised of a vehicle and spectrally sensitized silver halide tabular grains having an average tabularity of greater than 25, where the tabularity of each tabular grain is the ratio of its equivalent circular diameter in micrometers divided by the square of its thickness in micrometers, and, interposed between each of said emulsion layer units and said support, means for reducing crossover of radiation to which said emulsion layer units are responsive to less than 10 percent,

CHARACTERIZED IN THAT each of said emulsion layer units exhibit a coefficient of variation of less than 10 percent, based on their total grain population having an equivalent circular diameter of greater than 0.1 μm, greater than 97 percent of the projected area of the grain population having an equivalent circular diameter of greater than 0.1 μm being accounted for by tabular grains having a mean thickness of less than 0.3 μm and a halide content of bromide and from 0 to 5 mole percent iodide, based on total silver and the vehicle is comprised of a gelatino-peptizer containing less than 30 micromoles per gram of methionine and a polyalkylene oxide block copolymer surfactant having a molecular weight in the range of from 760 to 16,000 satisfying the formula:

LAO1—HAO1—LAO1 where

LAO1 in each occurrence represents a terminal lipophilic alkylene oxide block unit containing at least six —$CH(CH_3)CH_2O$— repeating units and HAO1 represents a hydrophilic alkylene oxide block linking unit containing —$CH_2CH_2O$— repeating units forming 4 to 35 percent of the total surfactant molecular weight.

20. A radiographic element according to claim 19 further characterized in that, the polyalkylene oxide block copolymer surfactant has a molecular weight in the range of from. 1000 to 10,000, LAO1 in each occurrence contains at least seven —$CH(CH_3)CH_2O$ — repeating units and HAO1 forms from 10 to 30 percent of the total surfactant molecular weight.

21. A radiographic element comprised of a film support capable of transmitting radiation to which said radiographic element is responsive having opposed major surfaces, and, coated on said opposed major surfaces, emulsion layer units comprised of a vehicle and spectrally sensitized silver halide tabular grains having an average tabularity of greater than 25, where the tabularity of each tabular grain is the ratio of its equivalent circular diameter in micrometers divided by the square of its thickness in micrometers, and, interposed between each of said emulsion layer units and said support, means for reducing crossover of radiation to which said emulsion layer units are responsive to less than 10 percent,

CHARACTERIZED IN THAT each of said emulsion layer units exhibit a coefficient of variation of less than 10 percent, based on the total grain population having an equivalent circular diameter of greater than 0.1 μm, greater than 97 percent of the projected area of the grain population having an equivalent circular diameter of greater than 0.1 μm being accounted for by tabular grains having a mean thickness of less than 0.3 μm and a halide content of bromide and from 0 to 5 mole percent iodide, based on total silver and the vehicle is comprised of a gelatino-peptizer containing at least 30 micromoles per gram of methionine and a polyalkylene oxide block copolymer surfactant having a molecular weight in the range of from 800 to 30,000 satisfying the formula:

HAO2—LAO2—HAO2 where

HAO2 each occurrence represents a terminal hydrophilic alkylene oxide block unit and LAO2 represents a lipophilic alkylene oxide block linking unit, contains at least thirteen —$CH(CH_3)CH_2O$— repeating units, and accounts for from 15 to 95 percent of the total surfactant molecular weight.

22. A radiographic element according to claim 21 further characterized in that the polyalkylene oxide block copolymer surfactant has a molecular weight in the range of from 1000 to 20,000 and LAO2 accounts for from 20 to 90 percent of the total surfactant molecular weight.

23. A radiographic element comprised of a film support capable of transmitting radiation to which said radiographic element is responsive having opposed major surfaces, and, coated on said opposed major surfaces, emulsion layer units comprised of a vehicle and spectrally sensitized silver halide tabular grains having an average tabularity of greater than 25, where the tabularity of each tabular grain is the ratio of its equivalent circular diameter in micrometers divided by the square of its thickness in micrometers, and, interposed between each of said emulsion layer units and said support, means for reducing crossover of radiation to which said emulsion layer units are responsive to less than 10 percent,

CHARACTERIZED IN THAT each of said emulsion layer units exhibit a coefficient of variation of less than 10 percent, based on the total grain population having an equivalent circular diameter of greater than 0.1 μm, greater than 97 percent of the projected area of the grain population having an equivalent circular diameter of greater than 0.1 μm being accounted for by tabular grains having a mean thickness of less than 0.3 μm and a halide content of bromide and from 0 to 5 mole percent iodide, based on total silver and the vehicle is comprised of a gelatino-peptizer containing less than 30 micromoles per gram of methionine and a polyalkylene oxide block copolymer surfactant having a molecular weight in the range of from 800 to 30,000 satisfying the formula:

HAO2—LAO2—HAO2 where

HAO2in each occurrence represents a terminal hydrophilic alkylene oxide block linking unit containing —$CH_2CH_2O$— repeating units and LAO2 represents a lipophilic alkylene oxide block linking unit containing at least thirteen —$CH(CH_3)CH_2O$— repeating units and accounting for from 40 to 96 percent of the total surfactant molecular weight.

24. A radiographic element according to claim 23 further characterized in that the polyalkylene oxide block copolymer surfactant has a molecular weight in the range of from 1000 to 20,000 and LAO2 represents 60 to 90 percent of the total surfactant molecular weight.

25. A radiographic element comprised of a film support capable of transmitting radiation to which said radiographic element is responsive having opposed major surfaces, and, coated on said opposed major surfaces, emulsion layer units comprised of a vehicle and spectrally sensitized silver halide tabular grains having an average tabularity of greater than 25, where the tabularity of each tabular grain is the ratio of its equivalent circular diameter in micrometers divided by the square of its thickness in micrometers, and, interposed between each of said emulsion layer units and said support, means for reducing crossover of radiation to which said emulsion layer units are responsive to less than 10 percent,

CHARACTERIZED IN THAT each of said emulsion layer units exhibit a coefficient of variation of less than 10 percent, based on the total grain population having an equivalent circular diameter of greater than 0.1 μm, greater than 97 percent of the projected area of the grain population having an equivalent circular diameter of greater than 0.1 μm being accounted for by tabular grains having a mean thickness of less than 0.3 μm and a halide content of bromide and from 0 to 5 mole percent iodide, based on total silver and the vehicle is comprised of a gelatino-peptizer containing at least 30 micromoles per gram of methionine and a polyalkylene oxide block copolymer surfactant having a molecular weight in the range of from 1,100 to 60,000 satisfying the formula:

$$(H—HAO3—LAO3)_2—L—(LAO3—HAO3—H)_2$$

where

L represents an ethylene diamine linking unit,

LAO3 in each occurrence represents a lipophilic alkylene oxide block unit containing at least three $—CH(CH_3)CH_2O—$ repeating units, HAO3 in each occurrence represents a hydrophilic alkylene oxide block unit containing at least two $—CH_2CH_2O—$ repeating units and L and LAO3 in all occurrences together account for 15 to 95 percent of the total surfactant molecular weight.

26. A radiographic emulsion according to claim 25 further characterized in that the polyalkylene oxide block copolymer surfactant has a molecular weight in the range of from 2,000 to 40,000 and L and $LAO_3$ in all occurrences together account for 20 to 90 percent of the total surfactant molecular weight.

27. A radiographic element comprised of a film support capable of transmitting radiation to which said radiographic element is responsive having opposed major surfaces, and, coated on said opposed major surfaces, emulsion layer units comprised of a vehicle and spectrally sensitized silver halide tabular grains having an average tabularity of greater than 25, where the tabularity of each tabular grain is the ratio of its equivalent circular diameter in micrometers divided by the square of its thickness in micrometers, and, interposed between each of said emulsion layer units and said support, means for reducing crossover of radiation to which said emulsion layer units are responsive to less than 10 percent,

CHARACTERIZED IN THAT each of said emulsion layer units exhibit a coefficient of variation of less than 10 percent, based on the total grain population having an equivalent circular diameter of greater than 0.1 μm, greater than 97 percent of the projected area of the grain population having an equivalent circular diameter of greater than 0.1 μm being accounted for by tabular grains having a mean thickness of less than 0.3 μm and a halide content of bromide and from 0 to 5 mole percent iodide, based on total silver and the vehicle is comprised of a gelatino-peptizer containing at least 30 micromoles per gram of methionine and a polyalkylene oxide block copolymer surfactant having a molecular weight in the range of from 1,100 to 50,000 satisfying the formula:

$$(H—LAO4—HAO4)_2—L'—(HAO4—LAO4—H)_2$$

where

L' represents an ethylene diamine linking unit,

LAO4 in each occurrence represents a lipophilic alkylene oxide block unit containing at least three $—CH(CH_3)CH_2O—$ repeating units, HAO4 in each occurrence represents a hydrophilic alkylene oxide block unit containing $—CH_2CH_2O—$ repeating units, and L' and LAO4 in all occurrences together account for 5 to 85 percent of the total surfactant molecular weight.

* * * * *